US010902966B2

(12) United States Patent
Kaneko

(10) Patent No.: US 10,902,966 B2
(45) Date of Patent: Jan. 26, 2021

(54) TWISTED WIRE CONDUCTOR FOR INSULATED ELECTRICAL WIRE, INSULATED ELECTRICAL WIRE, CORD AND CABLE

(71) Applicant: FURUKAWA ELECTRIC CO., LTD., Tokyo (JP)

(72) Inventor: Hiroshi Kaneko, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/961,508

(22) PCT Filed: Dec. 19, 2018

(86) PCT No.: PCT/JP2018/046820
§ 371 (c)(1),
(2) Date: Jul. 10, 2020

(87) PCT Pub. No.: WO2019/138820
PCT Pub. Date: Jul. 18, 2019

(65) Prior Publication Data

US 2020/0343014 A1 Oct. 29, 2020

(30) Foreign Application Priority Data

Jan. 12, 2018 (JP) ..... 2018-003831
Jan. 25, 2018 (JP) ..... 2018-010969
Jan. 25, 2018 (JP) ..... 2018-010970

(51) Int. Cl.
*H01B 11/02* (2006.01)
*H01B 1/02* (2006.01)
(Continued)

(52) U.S. Cl.
CPC ..... *H01B 1/02* (2013.01); *C22C 9/00* (2013.01); *C22C 21/02* (2013.01); *C22C 21/06* (2013.01);
(Continued)

(58) Field of Classification Search
CPC ..... H01B 1/02; H01B 7/0009; H01B 5/08; C22C 9/00; C22C 21/02; C22C 21/12; C22C 21/06; C22F 1/05
(Continued)

(56) References Cited

U.S. PATENT DOCUMENTS

2012/0267141 A1* 10/2012 Kamiyama ..... C22C 47/062 174/102 R
2013/0284488 A1 10/2013 Yabuki
2019/0136351 A1 5/2019 Kaneko et al.

FOREIGN PATENT DOCUMENTS

JP 2004-134212 A 4/2004
JP 2006-196375 A1 7/2006
(Continued)

OTHER PUBLICATIONS

Japanese Office Action dated Jun. 18, 2019 in Japanese Patent Application No. 2019-518118.
(Continued)

*Primary Examiner* — Sherman Ng
(74) *Attorney, Agent, or Firm* — Oblon, McClelland, Maier & Neustadt, L.L.P.

(57) ABSTRACT

This twisted wire conductor 10 for an insulated electrical wire is configured so as to be in a mixed state in which a first conductor 20 and a second conductor 40 are twisted together. The first conductor comprises a specific aluminum alloy: which has an alloy composition that contains, by mass %, 0.2-1.8% of Mg, 0.2-2.0% of Si, 0.01-0.33% of Fe and a total of 0.00-2.00% of one or more elements selected from
(Continued)

the group consisting of Cu, Ag, Zn, Ni, Co, Au, Mn, Cr, V, Zr, Ti and Sn, with the remainder comprising Al and unavoidable impurities; which has a fibrous metal structure in which crystal grains extend in one direction; and in which the average value of a dimension t which is perpendicular to the longitudinal direction of crystal grains is 400 nm or less in a cross section parallel to this one direction. The second conductor has a higher electrical conductivity than the first conductor 20 and comprises a metal or alloy selected from the group consisting of copper, copper alloys, aluminum and aluminum alloys. The twisted wire conductor exhibits high electrical conductivity, high strength and excellent bending fatigue resistance, and enables a reduction in weight.

17 Claims, 11 Drawing Sheets

(51) Int. Cl.

| | |
|---|---|
| ***C22C 21/02*** | (2006.01) |
| ***C22C 21/06*** | (2006.01) |
| ***C22C 21/12*** | (2006.01) |
| ***H01B 7/00*** | (2006.01) |
| ***C22C 9/00*** | (2006.01) |
| ***H01B 5/08*** | (2006.01) |
| ***H01B 7/04*** | (2006.01) |
| ***C22F 1/05*** | (2006.01) |

(52) U.S. Cl.
CPC ..... *C22C 21/12* (2013.01); *C22F 1/05* (2013.01); *H01B 5/08* (2013.01); *H01B 7/0009* (2013.01); *H01B 7/04* (2013.01)

(58) Field of Classification Search
USPC ..... 174/126.1
See application file for complete search history.

(56) References Cited

FOREIGN PATENT DOCUMENTS

| | | | |
|---|---|---|---|
| JP | 2010-280969 | A | 12/2010 |
| JP | 2012-119073 | A | 6/2012 |
| JP | 2016-225245 | A | 12/2016 |
| JP | 6356365 | B2 | 7/2018 |
| WO | WO 2013/146762 | A1 | 10/2013 |

OTHER PUBLICATIONS

Mori, N., "Overhead Cables and Underground Cables," Journal of the Electrical Society, Jan. 22, 1981, with English translation, 6 pages.
International Search Report dated Mar. 26, 2019 in PCT/JP2018/046820 filed on Dec. 19, 2018, 2 pages.

* cited by examiner

TWISTED WIRE CONDUCTOR FOR INSULATED ELECTRICAL WIRE, INSULATED ELECTRICAL WIRE, CORD AND CABLE

TECHNICAL FIELD

The present invention relates to a twisted wire conductor for an insulated electrical wire, an insulated electrical wire, a cord, and a cable.

BACKGROUND ART

Conventionally, copper-based conductor materials have been widely used for cables that transmit electric power or signals, which are called cabtire cables such as robot cables, elevator cables, and high voltage cables for vehicles. Among such cables, movable cables are configured to be capable of migrating (moving), and since it is assumed that in a conventional use mode, a force for pulling or bending concomitantly with migration acts repeatedly, it is desirable that movable cables have not only the characteristics for transmitting electric power or the like but also high tensile strength, and further have excellent characteristics for enduring repeated bending deformation, so-called bending fatigue resistance. Furthermore, regarding restraining cables such as high voltage cables for vehicles (electrical wires for transportation), which are used in moving bodies represented by aircrafts, automobiles, ships, and the like, since the restraining cables are subjected to vibration from power sources such as engines and motors or from the outside, it is desirable that the restraining cables have excellent characteristics of even enduring high-cycle deformation with a low strain amount caused by such vibration.

Furthermore, recently, from the viewpoint of weight reduction, an investigation has been conducted to use aluminum-based materials which have specific gravities as low as about ⅓ of the specific gravities of copper-based materials that have been widely used heretofore as twisted wire conductors constituting cables, and which also have high thermal expansion coefficients, relatively satisfactory conductivity for electricity and heat, and excellent corrosion resistance.

However, pure aluminum materials have problems that the materials have low strength compared to copper-based materials, and that the number of repetitions required until breakage in a bending fatigue test is small, while the bending fatigue resistance is also inferior. Furthermore, aluminum alloy materials of 2000 series (Al—Cu-based) and 7000 series (Al—Zn—Mg-based), which are aluminum-based alloy materials having relatively high bending fatigue resistance, have problems such as inferior corrosion resistance and stress corrosion cracking resistance and low electrical conductivity. Aluminum alloy materials of 6000 series having relatively excellent conductivity for electricity and heat and corrosion resistance are considered to have high bending fatigue resistance among aluminum-based alloy materials but have inferior bending fatigue resistance compared to copper-based materials, and therefore, further enhancement of the bending fatigue resistance is desirable.

Furthermore, since aluminum-based conductor materials have lower electrical conductivity compared to copper-based conductor materials, in a case in which all of the element wires (conductors) constituting a twisted wire conductor of a cable are formed from the aluminum-based material, from the viewpoint that aluminum-based materials have large amounts of heat generation compared to copper-based materials, for example, when continuous conduction for a long time period at a high current density or intermittent conduction is repeated, it is assumed that the entire cable may undergo self-heating up to high temperature (for example, above 90° C.). Therefore, it is considered that depending on the use conditions, the safety aspect needs to be taken into consideration.

For example, in Non-Patent Document 1, an aluminum conductor steel reinforced (ACSR), which is composed of a steel core and a plurality of lines of hard aluminum wires disposed around the steel core, is described. The aluminum conductor steel reinforced (ACSR) described in Non-Patent Document 1 is configured such that high tensile load (high tensile strength) is achieved by the steel core (steel wire) positioned at the center, and low electrical resistance (high electrical conductivity) is achieved by the hard aluminum wires disposed around the steel wire; however, the steel wire has low electrical conductivity compared to the copper wire, and weight reduction cannot be attempted. In addition, since the hard aluminum wires, which are conventional aluminum alloy wires, disposed around the steel wire have low strength compared to copper alloy wires, the hard aluminum wires cannot be used for cables on which a force for pulling or bending acts repeatedly, as in the case of movable cables such as cabtire cables and elevator cables, and for cables that are exposed to high-cycle deformation at a low strain amount caused by vibration, as in the cases of restraining cables such as high-voltage cables for vehicles.

Furthermore, in Patent Document 1, a twisted wire conductor for an insulated electrical wire is described, the twisted wire conductor being composed of a central element wire; an inner layer composed of a plurality of element wires disposed around the central element wire; and an outer layer composed of a plurality of element wires disposed around the inner layer, wherein the inner layer is composed of seven or more second element wires having a wire thickness equal to that of the central element wire, or a wire thickness finer than that of the central element wire, wherein the second element wires in the inner layer are respectively in contact with the central element wire, a configuration in which the second element wires in the inner layer adjoining each other are in contact with each other is employed, thereby the cross-sectional shape is close to a circular shape, and the twisted wire conductor will never bring deterioration of the bending characteristics.

However, it is an object of Patent Document 1 to suppress the deterioration of bending characteristics, and no investigation has been conducted on securing strength and electrical conductivity to an extent equal to those of copper alloy materials that are used for twisted wire conductors, while also attempting weight reduction.

Furthermore, described in Patent Document 2 is a copper-coated aluminum alloy wire obtained by providing copper coating on the aluminum alloy wire formed from the aluminum alloy containing 0.2% to 0.8% by mass of Si, 0.36% to 1.5% by mass of Fe, 0.45% to 0.9% by mass of Mg, and 0.005% to 0.03% by mass of Ti, with the remainder being Al and unavoidable impurities. It is described that this copper-coated aluminum alloy wire can provide an economically efficient conductor that includes flexibility and workability, has satisfactory wire drawability, has tensile strength while being highly electrically conductive, and is lightweight.

However, although the copper-coated aluminum alloy wire described in Patent Document 2 has slightly higher electrical conductivity than the electrical conductivity of pure aluminum wire, since the difference in the coefficient of thermal expansion between aluminum and copper is large, in a case in which the copper-coated aluminum alloy wire is subjected to a thermal history (heat cycle) of heat generation and cooling by, for example, repeatedly performing continuous conduction for long time period at a high current density or intermittent conduction, cracks are likely to be generated at the interface between the aluminum alloy wire and the copper coating.

Furthermore, when cracks propagate, the copper coating is detached from the aluminum alloy wire, and as a result, there is a problem that the electrical conductivity is decreased, and stable performance cannot be obtained.

Patent Document 1: Japanese Unexamined Patent Application, Publication No. 2012-119073

Patent Document 2: Japanese Unexamined Patent Application, Publication No. 2010-280969

Non-Patent Document 1: MORI, Norihiro, "V. Power transmission lines and underground cables", Journal of the Institute of Electrical Engineers of Japan, the Institute of Electrical Engineers of Japan, May 1981, Vol. 101, No. 5, p. 426-427

DISCLOSURE OF THE INVENTION

Problems to be Solved by the Invention

An object of the present invention is to provide a twisted wire conductor for an insulated electrical wire, which has high electrical conductivity and high strength and has excellent bending fatigue resistance, and can be reduced in weight, by using, as a twisted wire conductor, a first conductor formed from a specific aluminum alloy (material) having high strength and excellent bending fatigue resistance in place of a portion of a second conductor formed from conventional copper-based materials or aluminum-based materials, both having high electrical conductivity (low conductor resistance); and to provide an insulated electrical wire, a cord, and a cable.

Means for Solving the Problems

The main configurations of the present invention are as follows.

[1] A twisted wire conductor for an insulated electrical wire, the twisted wire conductor being configured to be in a mixed state in which first conductors and second conductors are twisted together, the first conductors comprising a specific aluminum alloy having an alloy composition containing, by mass %, 0.2% to 1.8% of Mg, 0.2% to 2.0% of Si, 0.01% to 0.33% of Fe, and 0.00% to 2.00% in total of one or more elements selected from the group consisting of Cu, Ag, Zn, Ni, Co, Au, Mn, Cr, V, Zr, Ti, and Sn, with the remainder being Al and unavoidable impurities, the specific aluminum alloy having a fibrous metal structure in which crystal grains extend to be aligned in one direction, and in a cross-section parallel to the one direction, the average value of a dimension perpendicular to the longitudinal direction of the crystal grains is 400 nm or less; and the second conductors comprising a metal or an alloy selected from the group consisting of copper, copper alloy, aluminum, and aluminum alloy, and having higher electrical conductivity than the first conductors.

[2] The twisted wire conductor for an insulated electrical wire as described in the above item [1], wherein when viewed from a transverse cross-section of the twisted wire conductor, the proportion B1 occupied by the number of first conductors in the total number of first conductors and second conductors, which are positioned in the outermost layer of the twisted wire conductor is higher than the proportion A occupied by the number of first conductors in the total number of first conductors and second conductors constituting the twisted wire conductor.

[3] The twisted wire conductor for an insulated electrical wire as described in the above item [2], wherein the ratio (B1/A) of the proportion B1 occupied by the number of first conductors in the total number of first conductors and second conductors, which are positioned in the outermost layer to the proportion A occupied by the number of first conductors in the total number of first conductors and second conductors constituting the twisted wire conductor, is 1.50 or greater.

[4] The twisted wire conductor for an insulated electrical wire as described in the above item [1], wherein when viewed from a transverse cross-section of the twisted wire conductor, the proportion B2 occupied by the number of first conductors in the total number of first conductors and second conductors, which are positioned within a region partitioned by a virtual circle that is concentric with a circumscribed circle of the twisted wire conductor and has a radius equal to a half of the radius of the circumscribed circle, is higher than the proportion A occupied by the number of first conductors in the total number of first conductors and second conductors constituting the twisted wire conductor.

[5] The twisted wire conductor for an insulated electrical wire as described in the above item [4], wherein the ratio (B2/A) of the proportion B2 occupied by the number of first conductors in the total number of first conductors and second conductors, which are positioned within the region to the proportion A occupied by the number of first conductors in the total number of first conductors and second conductors constituting the twisted wire conductor, is 1.50 or greater.

[6] The twisted wire conductor for an insulated electrical wire as described in any one of the above items [1] to [5], wherein when viewed from a transverse cross-section of the twisted wire conductor, the total cross-sectional area of the first conductors is in the range of 2% to 98% of the nominal cross-sectional area of the twisted wire conductor.

[7] The twisted wire conductor for an insulated electrical wire as described in any one of the above items [1] to [6], wherein the first conductors and the second conductors have the same diameter dimension.

[8] The twisted wire conductor for an insulated electrical wire as described in any one of the above items [1] to [6], wherein the first conductors and the second conductors have different diameter dimensions.

[9] The twisted wire conductor for an insulated electrical wire as described in any one of the above items [1] to [8], wherein the proportion A occupied by the number of first conductors in the total number of first conductors and second conductors constituting the twisted wire conductor is in the range of 2% to 98%.

[10] The twisted wire conductor for an insulated electrical wire as described in the above items [1] to [9], wherein the second conductors are constructed of the copper or the copper alloy.

[11] The twisted wire conductor for an insulated electrical wire as described in the above items [1] to [9], wherein the second conductors are constructed of the aluminum or the aluminum alloy.

[12] The twisted wire conductor for an insulated electrical wire as described in the above items [1] to [9], wherein the second conductors are formed in a mixed state of the copper or the copper alloy and the aluminum or the aluminum alloy.

[13] The twisted wire conductor for an insulated electrical wire as described in any one of the above items [1] to [12], wherein the alloy composition of the first conductors contains one or more elements selected from the group consisting of Cu, Ag, Zn, Ni, Co, Au, Mn, Cr, V, Zr, Ti, and Sn in a total amount of 0.06% to 2.00% by mass.

[14] An insulated electrical wire comprising the twisted wire conductor as described in any one of the above items [1] to [13]; and an insulating coating covering the outer periphery of the twisted wire conductor.

[15] A cord comprising the twisted wire conductor as described in any one of the above items [1] to [13]; and an insulating coating covering the outer periphery of the twisted wire conductor.

[16] A cable comprising the insulated electrical wire as described in the above [14] or the cord described in the above [15]; and a sheath providing an insulating coating so as to include the insulated electrical wire or the cord.

[17] The cable as described in the above item [16], wherein the cable is a cabtire cable.

Effects of the Invention

The present invention can provide a twisted wire conductor for an insulated electrical wire, the twisted wire conductor being configured to be in a mixed state in which first conductors and second conductors are twisted together, the first conductors each comprising a specific aluminum alloy having an alloy composition containing, by mass %, 0.2% to 1.8% of Mg, 0.2% to 2.0% of Si, 0.01% to 0.33% of Fe, and 0.00% to 2.00% in total of one or more elements selected from the group consisting of Cu, Ag, Zn, Ni, Co, Au, Mn, Cr, V, Zr, Ti, and Sn, with the remainder being Al and unavoidable impurities, the specific aluminum alloy having a fibrous metal structure in which crystal grains extend to be aligned in one direction, and in a cross-section parallel to the one direction, the average value of a dimension perpendicular to the longitudinal direction of the crystal grains is 400 nm or less; and the second conductor each comprising a metal or an alloy selected from the group consisting of copper, copper alloy, aluminum, and aluminum alloy, and having higher electrical conductivity than the first conductors. Thus, by using, as a twisted wire conductor, a first conductor comprising a specific aluminum alloy having high strength and excellent bending fatigue resistance in place of a portion of a second conductor comprising conventional copper-based materials or aluminum-based materials which have high electrical conductivity (low conductor resistance), it is possible to provide a twisted wire conductor for an insulated electrical wire, which has high electrical conductivity and high strength and has excellent bending fatigue resistance, and can be reduced in weight; an insulated electrical wire; a cord; and a cable.

PREFERRED MODE FOR CARRYING OUT THE INVENTION

Next, preferred embodiments of the twisted wire conductor for an insulated electrical wire according to the present invention will be described in detail below. The twisted wire conductor for an insulated electrical wire according to the present invention is configured to be in a mixed state in which first conductors and second conductors are twisted together, the first conductors each comprising a specific aluminum alloy having an alloy composition containing, by mass %, 0.2% to 1.8% of Mg, 0.2% to 2.0% of Si, 0.01% to 0.33% of Fe, and 0.00% to 2.00% in total of one or more elements selected from the group consisting of Cu, Ag, Zn, Ni, Co, Au, Mn, Cr, V, Zr, Ti, and Sn, with the remainder being Al and unavoidable impurities, the specific aluminum alloy having a fibrous metal structure in which crystal grains extend to be aligned in one direction, and in a cross-section parallel to the one direction, the average value of a dimension perpendicular to the longitudinal direction of the crystal grains is 400 nm or less; and the second conductors each comprising a metal or an alloy selected from the group consisting of copper, copper alloy, aluminum, and aluminum alloy, and having higher electrical conductivity than the first conductors.

[First Conductor]

The first conductor is formed using a specific aluminum alloy (material) having an alloy composition containing, by mass %, 0.2% to 1.8% of Mg, 0.2% to 2.0% of Si, 0.01% to 0.33% of Fe, and 0.00% to 2.00% in total of one or more elements selected from the group consisting of Cu, Ag, Zn, Ni, Co, Au, Mn, Cr, V, Zr, Ti, and Sn, with the remainder being Al and unavoidable impurities, the specific aluminum alloy having a fibrous metal structure in which crystal grains extend to be aligned in one direction, and in a cross-section parallel to the one direction, the average value of a dimension perpendicular to the longitudinal direction of the crystal grains is 400 nm or less.

Here, among the element components of the alloy composition described above, an element component for which the lower limit of the content range is described as "0.00%" appropriately means a component that is optionally added to the aluminum alloy material as necessary. That is, in a case in which an element component is "0.00%", it is implied that the element component is substantially not included in the aluminum alloy material.

Meanwhile, in the present specification, the term "crystal grain" refers to a portion surrounded by orientation difference boundaries, and the term "orientation difference boundaries" as used herein refers to boundaries at which the contrast changes discontinuously when a metal structure is observed according to scanning transmission electron microscopy (STEM). Furthermore, a dimension perpendicular to the longitudinal direction of a crystal grain corresponds to the interval of the orientation difference boundaries.

Figure 1:
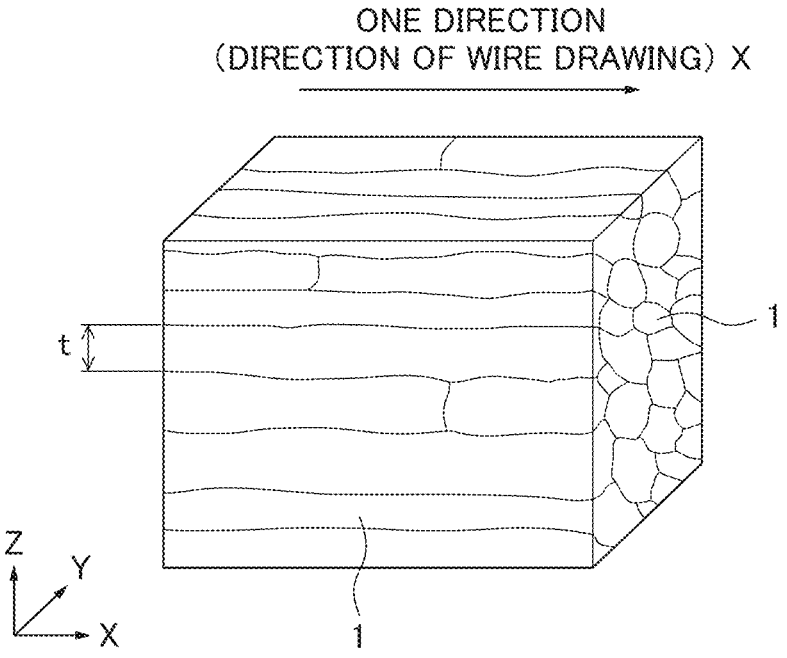
FIG. 1 is a perspective view schematically illustrating the metal structure of a specific aluminum alloy material of a first conductor that constitutes a twisted wire conductor for an insulated electrical wire according to the present invention so that the metal structure can be understood three-dimensionally.

Furthermore, the specific aluminum alloy has a fibrous metal structure in which crystal grains extend to be aligned in one direction. Here, a perspective view schematically illustrating the metal structure of the specific aluminum alloy material so that the metal structure can be understood three-dimensionally is illustrated in FIG. 1. The specific aluminum alloy (material) has, as illustrated in FIG. 1, a fibrous structure in which crystal grains 1 having an elongated shape are in a state of extending to be aligned in one direction X. Such crystal grains having an elongated shape are significantly different from conventional fine crystal grains or flat crystal crystals that simply have a large aspect ratio. That is, the crystal grains of the present invention have an elongated shape such as that of fibers, and the average value of a dimension t perpendicular to the longitudinal direction X thereof is 400 nm or less. A fibrous metal structure in which such fine crystal grains extend to be aligned in one direction can be said to be a novel metal structure that does not exist in conventional aluminum alloy (materials).

A first conductor comprising the specific aluminum alloy (material) has a fibrous metal structure in which crystal grains extend to be aligned in one direction, and in a cross-section parallel to the one direction, the average value of a dimension perpendicular to the longitudinal direction of the crystal grains is controlled to be 400 nm or less. Therefore, the first conductor can realize high strength comparable to iron-based or copper-based alloy materials, excellent bending fatigue resistance, and weight reduction. Fatigue fracture of a conductor caused by repeated deformation such as bending or torsion occurs as a result of crystal grain boundaries and a particular crystal orientation, which promote stress concentration and localized deformation. Non-uniformity of such a crystal structure is suppressed by refining the crystal grains and has an action of making it difficult to cause fatigue fracture.

Furthermore, making the crystal grain diameter fine is directly linked to an action of improving grain boundary corrosion, an action of reducing roughness of the surface after performing plastic working, an action of reducing undercut or burr at the time of performing shearing, and the like, and has an effect of generally enhancing the functions of a material.

(1) Alloy Composition

Next, the component composition of the specific aluminum alloy (material) that constitutes the first conductor will be explained below together with actions.

<Mg: 0.2 Mass % to 1.8 Mass %>

Mg (magnesium) has an action of solid-solutioning into the aluminum base metal and thereby reinforcing the aluminum base metal, and also has an action of enhancing the tensile strength by means of a synergistic effect with Si. Furthermore, Mg is an element having an action of enhancing the tensile strength and elongation in a case in which Mg—Si clusters are formed as solute atom clusters. However, when the Mg content is less than 0.2 mass %, the above-described operating effects are insufficient, and when the Mg content is more than 1.8 mass %, crystallization products are formed, and workability (wire drawing workability, bending workability, and the like) is deteriorated. Therefore, the Mg content is adjusted to 0.2 mass % to 1.8 mass %, and the Mg content is preferably 0.4 mass % to 1.0 mass %.

<Si: 0.2 Mass % to 2.0 Mass %>

Si (silicon) has an action of solid-solutioning into the aluminum base metal and thereby reinforcing the aluminum base metal, and also has an action of enhancing the tensile strength or bending fatigue resistance by means of a synergistic effect with Mg. Furthermore, Si is an element having an action of enhancing the tensile strength and elongation in a case in which Si forms Mg—Si clusters or Si—Si clusters as solute atom clusters. However, when the Si content is less than 0.2 mass %, the above-described operating effects are insufficient, and when the Si content is more than 2.0 mass %, crystallization products are formed, and workability is deteriorated. Therefore, the Si content is adjusted to 0.2 mass % to 2.0 mass %, and the Si content is preferably 0.4 mass % to 1.0 mass %.

<Fe: 0.01 Mass % to 0.33 Mass %>

Fe (iron) contributes to the refinement of crystal grains mainly by forming an Al—Fe-based intermetallic compound. Here, an intermetallic compound refers to a compound composed of two or more kinds of metals. Since Fe can solid-solution into Al at a proportion of 0.05 mass % only at 655° C., and the proportion is smaller at room temperature, the remainder of Fe that cannot be solid-solutioned into Al is crystallized or precipitated as Al—Fe-based, Al—Fe—Si-based, and Al—Fe—Si—Mg-based intermetallic compounds, and the like. Intermetallic compounds composed mainly of Fe and Al such as these are referred to as Fe-based compounds in the present specification. These intermetallic compounds contribute to the refinement of crystal grains. When the Fe content is less than 0.01 mass %, these operating effects are insufficient, and when the Fe content is more than 0.33 mass %, the amount of crystallization products becomes large, while workability is deteriorated. Here, a crystallization product refers to an intermetallic compound generated at the time of casting solidification of an alloy. Therefore, the Fe content is adjusted to 0.01 mass % to 0.33 mass %, and the Fe content is preferably 0.05 mass % to 0.29 mass %. Meanwhile, in a case in which the cooling rate at the time of casting is slow, dispersion of the Fe-based compounds becomes sparse, and the degree of adverse effect becomes high. Therefore, it is more preferable that the Fe content is adjusted to be less than 0.25 mass %, and even more preferably less than 0.20 mass %.

<At Least One or More Selected from Cu, Ag, Zn, Ni, Co, Au, Mn, Cr, V, Zr, Ti, and Sn: 0.06 Mass % to 2.00 Mass % in Total>

Cu (copper), Ag (silver), Zn (zinc), Ni (nickel), Co (cobalt), Au (gold), Mn (manganese), Cr (chromium), V (vanadium), Zr (zirconium), Ti (titanium), and Sn (tin) are all elements that enhance heat resistance. These components are optionally incorporated components that can be incorporated as necessary, and these components may be incorporated singly or may be incorporated in combination of two or more kinds thereof. These components can be incorporated at a proportion of 0.00 mass % to 2.00 mass % in total, and it is preferable to incorporate these components at a proportion of 0.06 mass % to 2.00 mass %.

When the sum of the contents of these components is less than 0.06 mass %, there is a tendency that the above-described operating effects cannot be sufficiently obtained, and when the sum of the contents of these components is more than 2.00 mass %, there is a tendency that workability is deteriorated. Therefore, the sum of the contents of at least one or more selected from Cu, Ag, Zn, Ni, Co, Au, Mn, Cr, V, Zr, Ti, and Sn is adjusted to 0.06 mass % to 2 mass %, and the sum is preferably 0.3 mass % to 1.2 mass %. Particularly, when the corrosion resistance in the case of being used in a corrosive environment is taken into consideration, it is preferable that any one or more selected from Zn, Ni, Co, Mn, Cr, V, Zr, Ti, and Sn are incorporated.

Regarding the mechanism by which the above-described components enhance heat resistance, for example, a mechanism of lowering the energy of the crystal grain boundaries because the difference between the atomic radii of the above-described components and the atomic radius of aluminum is large, a mechanism of lowering the degree of mobility of grain boundaries in a case in which the above-described components penetrate into the grain boundaries because the coefficients of diffusion of the above-described components are large, a mechanism of retarding the phenomenon of diffusion because the interaction of the components with voids is large so that the above-described components trap voids, and the like may be mentioned. It is considered that these mechanisms act synergistically.

<Remainder: Al and Unavoidable Impurities>

The remainder other than the above-described components is Al (aluminum) and unavoidable impurities. The unavoidable impurities as used herein mean impurities at a content level that can be unavoidably included in view of the production process. Since the unavoidable impurities can become a causative factor that decreases the electrical conductivity depending on the content, it is preferable to suppress the content of the unavoidable impurities to a certain extent by taking a decrease in the electrical conductivity into account. Examples of a component that may be listed as the unavoidable impurities include B (boron), Bi (bismuth), Pb (lead), Ga (gallium), and Sr (strontium). Meanwhile, the upper limit of the contents of these components may be adjusted to 0.05 mass % or less for each of the above-described components, and to 0.15 mass % or less as the total amount of the above-described components.

[Second Conductor]

A second conductor comprises a metal or an alloy selected from the group consisting of copper, copper alloy, aluminum, and aluminum alloy, the metal or the alloy having higher electrical conductivity (lower conductor resistance) than the first conductor. The first conductor can realize high strength comparable to that of iron-based or copper-based alloy materials, excellent bending fatigue resistance, and weight reduction; however, since the electrical conductivity is lower than that of copper-based materials, for example, when continuous conduction for a long time period at a high current density or intermittent conduction is repeated, it is assumed that the entire cable may undergo self-heating to a high temperature (for example, above 90° C.), and therefore, depending on the use conditions, the safety aspect needs to be taken into consideration.

Therefore, it is necessary that the twisted wire conductor of the present invention is configured to be in a mixed state in which first conductors and second conductors having higher electrical conductivity than these first conductors and comprising a metal or an alloy selected from the group consisting of copper, copper alloy, aluminum, and aluminum alloy are twisted together. When the twisted wire conductor of the present invention is configured to be in a mixed state in which first conductors and second conductors are twisted together, the electrical conductivity that tends to be insufficient with the first conductors can be supplemented by the second conductors having high electrical conductivity, and as a result, for example, even if continuous conduction for a long time period at a high current density or intermittent conduction is repeated, the entire cable reaching a high temperature (for example, above 90° C.) can be prevented.

Meanwhile, in a case in which lowering of the conductor resistance is considered important, it is preferable that the second conductors are formed from copper or the above-mentioned copper alloy. Specific examples of the copper-based material to be used as the second conductors include oxygen-free copper, tough pitch copper, phosphorus deoxidized copper, Cu—Ag-based alloys, Cu—Sn-based alloys, Cu—Mg-based alloys, Cu—Cr-based alloys, Cu—Mg—Zn-based alloys, as well as the copper alloys for conductors as defined in ASTM B105-05. Furthermore, it is also acceptable to use plated wires obtained by plating these copper-based materials with Sn, Ni Ag, Cu, and the like. The cross-sectional shape of a wire comprising the second conductor is not limited to a circular shape.

Furthermore, in a case in which weight reduction of the conductor is considered important, it is preferable that the second conductors are formed from the above-mentioned aluminum or the above-mentioned aluminum alloy. Specific examples of the aluminum-based material to be used as the second conductors include ECAL, Al—Zr-based alloys, 5000 series alloys, Al—Mg—Cu—Si-based alloys, and 8000 series alloys defined in ASTM B800-05. It is also acceptable to use plated wires obtained by plating these aluminum-based materials with Sn, Ni, Ag, Cu, and the like. The cross-sectional shape of a wire comprising the second conductor is not limited to a circular shape.

Furthermore, regarding the second conductors, it is preferable that two or more kinds of second conductors having different compositions, which are selected from the group consisting of copper or the above-mentioned copper alloy and the above-mentioned aluminum or the above-mentioned aluminum alloy, are used, and the twisted wire conductor is configured to be in a mixed state between these two or more kinds of second conductors and the first conductors.

[Twisted Wire Conductor for Insulated Electrical Wire]

Figure 2B:
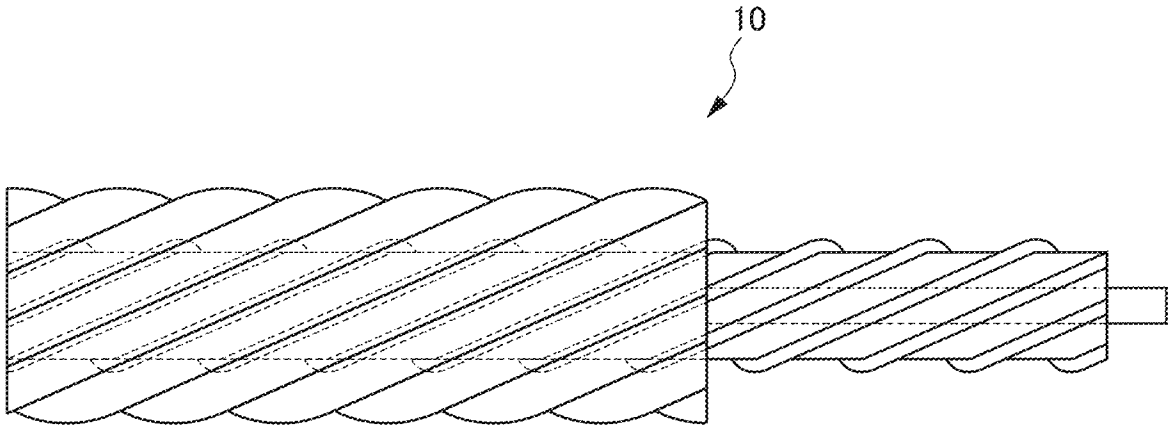
FIGS. 2(*a*) and 2(*b*) are diagrams schematically illustrating a first embodiment of the twisted wire conductor for an insulated electrical wire of the present invention, the first embodiment being the case of configuring the twisted wire conductor into a concentrically twisted wire having a 1×19 structure, FIG. 2(*a*) is a transverse cross-sectional view, and FIG. 2(*b*) is a plan view of the twisted wire conductor obtainable when the conductors positioned in the outermost layer and the conductors positioned adjacently to the inner side thereof are partially cut off so that the twisted state of the conductors constituting the twisted wire conductor can be understood.
Figure 2A:
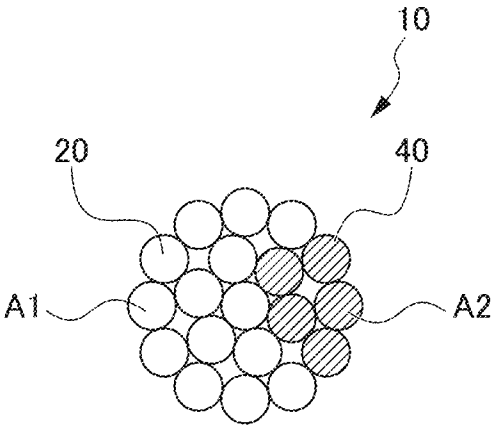

The twisted wire conductor for an insulated electrical wire according to the present invention is configured to be in a mixed state in which the above-mentioned first conductors and second conductors are twisted together. FIG. 2 is diagrams schematically illustrating the first embodiment of the twisted wire conductor for an insulated electrical wire of the present invention, and FIG. 2(*a*) is a transverse cross-sectional view, while FIG. 2(*b*) is a plan view of the twisted wire conductor obtainable when the conductors positioned in the outermost layer and the conductors positioned adjacently to the inner side thereof are partially cut off so that the twisted state of the conductors constituting the twisted wire conductor can be understood.

The twisted wire conductor 10 of the present invention is configured to have first conductors 20 and second conductors 40, and the first embodiment illustrated in FIG. 2 represents the case of a concentrically twisted wire configured to have a 1×19 twist structure, in which all of nineteen conductors in total, including fourteen first conductors 20 and five second conductors 40, are twisted together in the S-twist (twist of clockwise rotation) direction at the same pitch, the concentrically twisted wire using first conductors 20 and second conductors 40 that have the same wire diameter. Meanwhile, in FIG. 2(*a*), in order to distinguish between the first conductors 20 and the second conductors 40, only the second conductors 40 are hatched with oblique lines.

As the twisted wire conductor 10 of the present invention uses two kinds of conductors having different characteristics (first conductors 20 and second conductors 40) and is configured to be in a mixed state in which these conductors 20 and 40 are twisted together, the twisted wire conductor 10 has high electrical conductivity and high strength and exhibits excellent bending fatigue resistance, and further weight reduction can also be attempted.

Figure 3B:
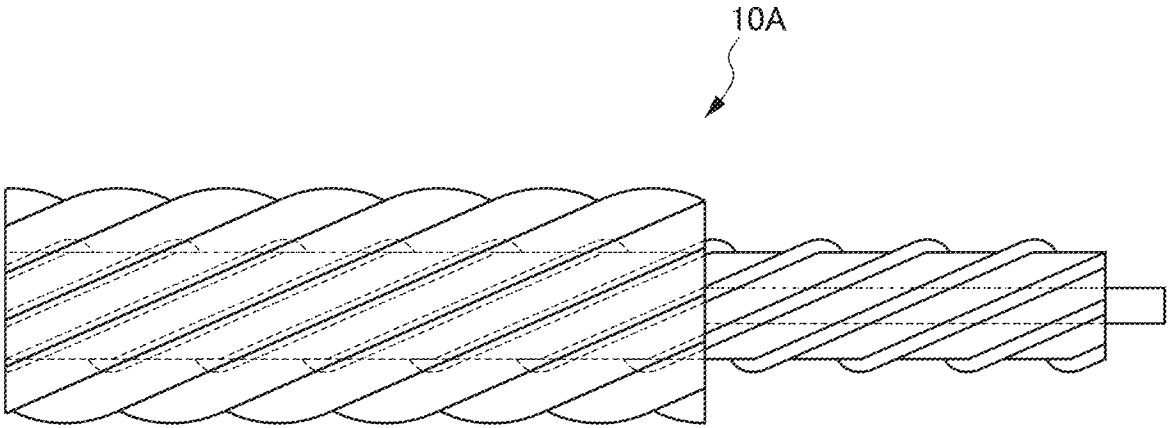
FIGS. 3(*a*) and 3(*b*) are diagrams schematically illustrating a second embodiment of the twisted wire conductor for an insulated electrical wire of the present invention, the second embodiment being the case of configuring the twisted wire conductor into a concentrically twisted wire having a 1×19 structure, FIG. 3(*a*) is a transverse cross-sectional view, and FIG. 3(*b*) is a plan view of the twisted wire conductor obtainable when the conductors positioned in the outermost layer and the conductors positioned adjacently to the inner side thereof are partially cut off so that the twisted state of the conductors constituting the twisted wire conductor can be understood.
Figure 3A:
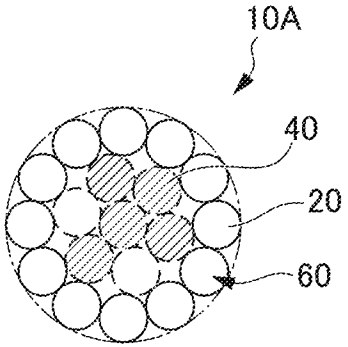

FIG. 3 is a diagram schematically illustrating a second embodiment of the twisted wire conductor for an insulated electrical wire of the present invention, the twisted wire conductor being the case of configuring the twisted wire conductor into a concentrically twisted wire having a 1×19 structure, and FIG. 3(*a*) is a transverse cross-sectional view, while FIG. 3(*b*) is a plan view of the twisted wire conductor obtainable when the conductors positioned in the outermost layer and the conductors positioned adjacently to the inner side thereof are partially cut off so that the twisted state of the conductors constituting the twisted wire conductor can be understood.

The twisted wire conductor 10A for an insulated electrical wire of the second embodiment is composed of first conductors 20 and second conductors 40 as illustrated in FIG. 3, and when viewed from a transverse cross-section of the twisted wire conductor 10A, the proportion B1 occupied by the number of first conductors 20 in the total number of first conductors 20 and second conductors 40, which are positioned in the outermost layer 60 of the twisted wire conductor 10A, is higher than the proportion A occupied by the number of first conductors 20 in the total number of first conductors 20 and second conductors 40 constituting the twisted wire conductor 10A.

Here, the transverse cross-section of the twisted wire conductor 10A is a cross-section perpendicular to the longitudinal direction of the twisted wire conductor 10A. Furthermore, the outermost layer 60 is a layer comprising a plurality of conductors which are positioned in the outer periphery of the twisted wire conductor 10A when viewed from the transverse cross-section of the twisted wire conductor 10A. Meanwhile, with regard to the twisted wire conductor 10A of the second embodiment illustrated in FIG. 3(*a*), as well as a twisted wire conductor 10B of a third embodiment illustrated in FIG. 4 and a twisted wire conductor 10C of a fourth embodiment illustrated in FIG. 5, which will be described below, the contour lines of the first conductors 20 and the second conductors 40 that are positioned in the outermost layer 60 are represented by solid lines, and the contour lines of the first conductors 20 and the second conductors 40 that are not positioned in the outermost layer 60 are represented by broken lines. In a transverse cross-section of an arbitrary portion in the longitudinal direction of the twisted wire conductor 10A, the proportion B1 occupied by the number of first conductors 20 in the total number of first conductors 20 and second conductors 40, which are positioned in the outermost layer 60, is always higher than the proportion A occupied by the number of first conductors 20 in the total number of first conductors 20 and second conductors 40 constituting the twisted wire conductor 10.

The embodiment illustrated in FIG. 3 represents the case of a concentrically twisted wire configured to have a 1×19 twist structure, in which all of nineteen conductors in total, including fourteen first conductors 20 and five second conductors 40, are twisted together in the S-twist (twist of clockwise rotation) direction at the same pitch, and the concentrically twisted wire uses first conductors 20 and second conductors 40 having the same wire diameter, in which the total number of first conductors 20 positioned in the outermost layer 60 is 12, and the total number of second conductors 40 positioned in the outermost layer 60 is 0. Meanwhile, in FIG. 3(*a*), in order to distinguish between the first conductors 20 and the second conductors 40, only the second conductors 40 are hatched with oblique lines.

Specifically, in the embodiment illustrated in FIG. 3, with regard to the conductors positioned in the outermost layer 60 of the twisted wire conductor 10A, the proportion B1 occupied by the number of first conductors 20 in the total number (12 pieces) of first conductors 20 (12 pieces) and second conductors 40 (0 pieces) is 100%. Furthermore, the proportion A occupied by the number of first conductors 20 in the total number (19 pieces) of first conductors 20 (14 pieces) and second conductors 40 (5 pieces), which constitute the twisted wire conductor 10A, is 73.68%. Then, the proportion B1 of the number of first conductors 20 (100%) is higher than the proportion A of the number of first conductors (73.68%).

Figure 4:
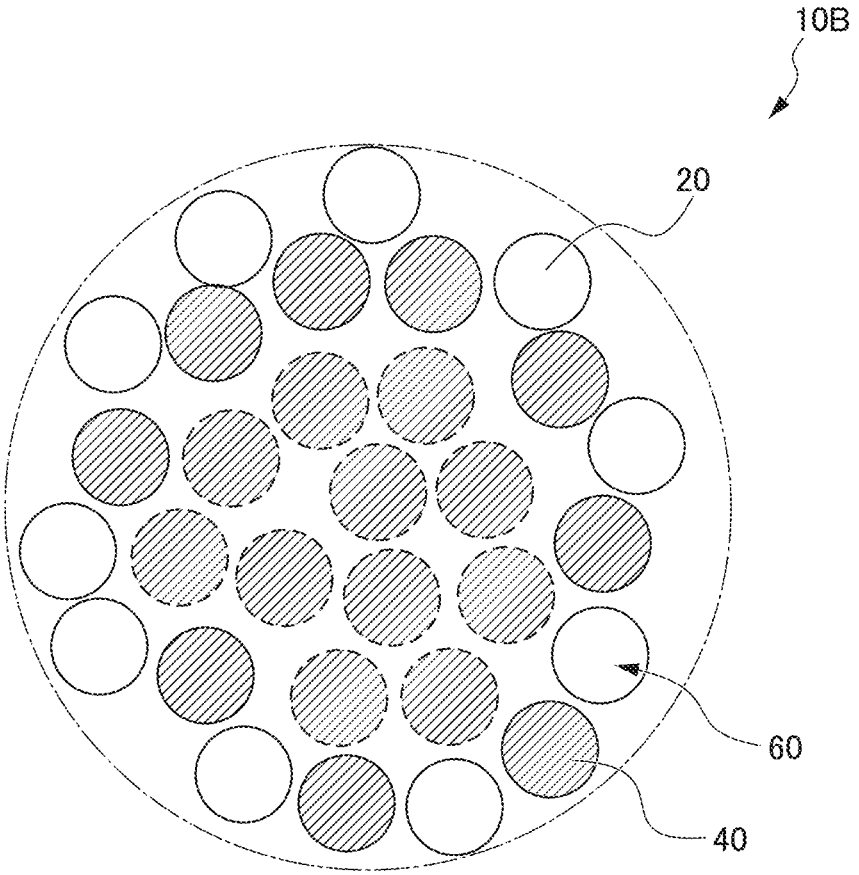
FIG. 4 is a diagram schematically illustrating a third embodiment of a twisted wire conductor for an insulated electrical wire of the present invention and is a transverse cross-sectional view of an assembled twisted wire formed by twisting together thirty conductors in total.

Furthermore, FIG. 4 is a transverse cross-sectional view illustrating a twisted wire conductor 10B of a third embodiment, the twisted wire conductor 10B being an assembled twisted wire formed by twisting together thirty conducting wires in total (first conductors and second conductors) in one direction in a bundled state. Specifically, in the third embodiment, the proportion B1 occupied by the number of first conductors 20 in the total number (19 pieces) of first conductors 20 (10 pieces) and second conductors 40 (9 pieces), which are positioned in the outermost layer 60 of the twisted wire conductor 10B, is 52.63%. Furthermore, the proportion A occupied by the number of first conductors 20 in a total number of thirty of the first conductors 20 (10 pieces) and the second conductors 40 (20 pieces) constituting the twisted wire conductor 10B is 33.33%. Further, the proportion B1 of the number of first conductors 20 (52.63%) is greater than the proportion A of the number of first conductors 20 (33.33%).

Figure 5:
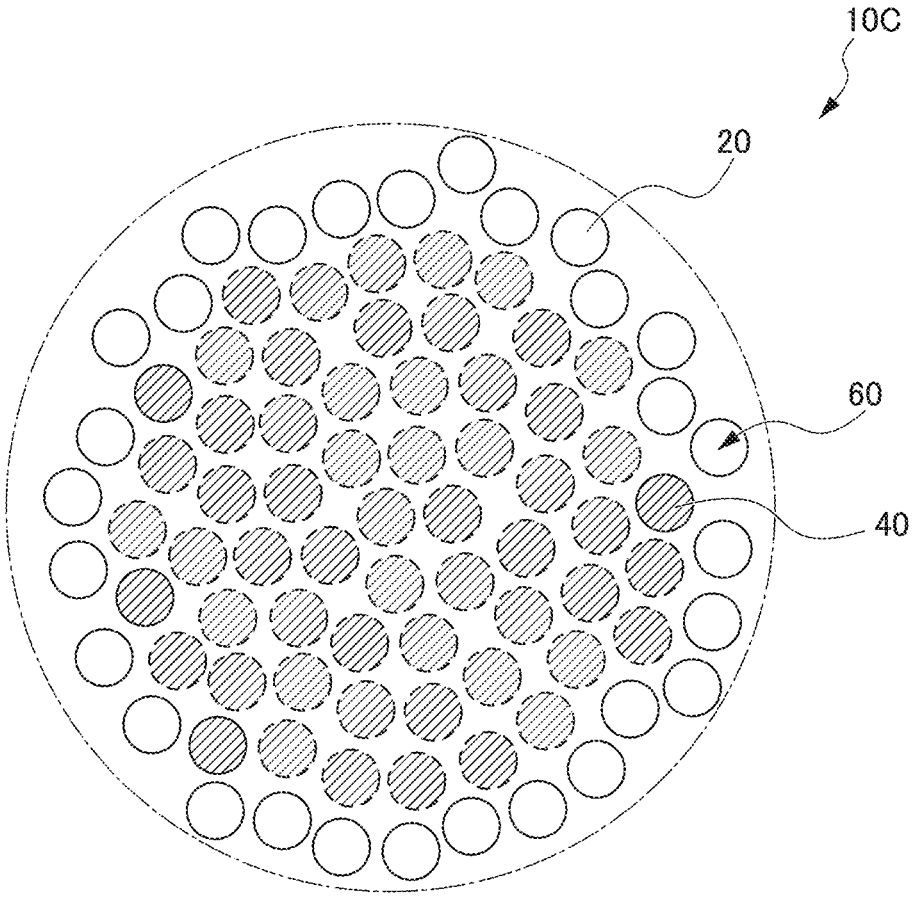
FIG. 5 is a diagram schematically illustrating a fourth embodiment of a twisted wire conductor for an insulated electrical wire of the present invention and is a transverse cross-sectional view of an assembled twisted wire formed by twisting together eighty-eight conductors in total.

Furthermore, FIG. 5 is a transverse cross-sectional view illustrating a twisted wire conductor 10C of a fourth embodiment, the twisted wire conductor 10C being an assembled twisted wire formed by twisting together eighty-eight conducting wires in total (first conductors and second conductors) in one direction in a bundled state. Specifically, with regard to the twisted wire conductor 10C of the fourth embodiment, the proportion B1 occupied by the number of first conductors 20 in the total number (33 pieces) of first conductors 20 (29 pieces) and second conductors 40 (4 pieces), which are positioned in the outermost layer 60 of the twisted wire conductor 10C, is 87.88%. Furthermore, the proportion A occupied by the number of first conductors 20 in the total number (88 pieces) of first conductors 20 (29 pieces) and second conductors 40 (59 pieces) constituting the twisted wire conductor 10C is 32.95%. Further, the proportion B1 of the number of first conductors 20 (87.88%) is higher than the proportion A (32.95%) of the number of first conductors 20.

With regard to the twisted wire conductors 10A, 10B, and 10C of the second to fourth embodiments, the ratio (B1/A) of the proportion B1 occupied by the number of first conductors 20 in the total number of first conductors 20 and second conductors 40, which are positioned in the outermost layer 60, and the proportion A occupied by the number of first conductors 20 in the total number of first conductors 20 and second conductors 40 constituting the twisted wire conductor 10, is preferably 1.50 or higher, and more preferably 1.70 or higher. As the proportion B1 of the number of first conductors 20 with respect to the proportion A of the number of first conductors 20 is higher, the bending fatigue resistance, weight reduction, connectivity to the aluminum terminal, uniformity of the temperature distribution, and the difficulty in deformation (non-easiness in deformation) of the twisted wire conductors 10A, 10B, and 10C are enhanced. When the ratio (B1/A) is 1.50 or higher, the effect of enhancing these characteristics is sufficient.

Here, the connectivity to the aluminum terminal implies the connectivity between the aluminum terminal such as a sleeve terminal formed from the aluminum-based material, and a twisted wire conductor. Generally, in a case in which two dissimilar metal members are connected, it is necessary to take the galvanic corrosion and the difference in the coefficient of thermal expansion between the members into consideration. For example, in a case in which a terminal is formed from the aluminum-based material, since a large number of first conductors formed from a specific aluminum alloy are disposed at a high existence ratio in the outermost layer 60 of the twisted wire conductor, in the connection between the twisted wire conductors 10A, 10B, and 10C and the aluminum terminal, the proportion of homogeneous metal connection becomes larger than the proportion of dissimilar metal connection. Therefore, galvanic corrosion or the difference in the coefficient of thermal expansion is suppressed, and the connectivity between the twisted wire conductors 10A, 10B, and 10C and the terminal is enhanced. Accordingly, the twisted wire conductors 10A, 10B, and 10C and the terminal can be connected stably for a long time period.

Furthermore, the uniformity of the temperature distribution implies the uniformity of the temperature distribution at the time of electricity conduction to a twisted wire conductor. When a current flows to a twisted wire conductor, since Joule heat is generated in the twisted wire conductor, the temperature of the twisted wire conductor increases. Here, the conductors positioned in the outermost layer of the twisted wire conductor easily dissipate heat because these conductors are in contact with external air, and because the conductors positioned in the inner portion of the twisted wire conductor is likely to confine heat and does not easily dissipate heat, the temperature distribution of the twisted wire conductor becomes non-uniform. Therefore, as in the case of the twisted wire conductors 10A, 10B, and 10C of the second to fourth embodiments, when a larger number of second conductors having higher thermal conductivity than the first conductors are disposed in the inner portion of the twisted wire conductor, and at the same time, a larger number of first conductors having lower thermal conductivity than the second conductors are disposed in the outermost layer 60 of the twisted wire conductor, the uniformity of the temperature distributions of the twisted wire conductors 10A, 10B, and 10C is enhanced. Therefore, even if an electric current is caused to flow through the twisted wire conductors 10A, 10B, and 10C for a long time period, the twisted wire conductors 10A, 10B, and 10C can pass the current stably.

Furthermore, the difficulty in deformation is as follows. When a cable or a wiring is handled, a load of bending the cable or wiring, or winding the cable or wiring around a bobbin or a reel is applied. At this time, the cable or wiring undergoes plastic deformation, and when the cable or wiring acquires a bending habit or a winding habit, uniform deformation of the cable or wiring is inhibited, thus causing breaking of wire or causing a disaster based on violent behavior of wire. Regarding the twisted wire conductors 10A, 10B, and 10C of the second to fourth embodiments, since the difficulty in deformation of the twisted wire conductors 10A, 10B, and 10C is enhanced by disposing a large number of first conductors 10 that do not easily undergo plastic deformation in the outermost layer 60 at a high existence ratio, the problems described above can be solved.

Meanwhile, in the above description, an example in which, when viewed from a transverse cross-section of the twisted wire conductor 10A, 10B, or 10C, a circumscribed circle of the twisted wire conductor is a true circle is disclosed; however, the circumscribed circle of the twisted wire conductors may be any arbitrary shape such as a semi-circle shape, an elliptical shape, or a shape resulting from arbitrary deformation of a true circle. In this case, the radius of a virtual true circle is calculated from the area of the arbitrary shape, and a virtual true circle drawn based on the radius thus calculated by taking the center of gravity of the arbitrary shape as the center, is regarded as the circumscribed circle of the twisted wire conductor.

Furthermore, in a case in which lowering of the conductor resistance and the uniformity of the temperature distribution are considered important, it is preferable that the second conductors are constructed of copper or copper alloy. Specific examples of the copper-based material to be used as the second conductors include oxygen-free copper, tough pitch copper, phosphorus deoxidized copper, Cu—Ag-based alloys, Cu—Sn-based alloys, Cu—Mg-based alloys, Cu—Cr-based alloys, Cu—Mg—Zn-based alloys, as well as the copper alloys for conductors as defined in ASTM B105-05. Furthermore, it is also acceptable to use plated wires obtained by plating these copper-based materials with Sn, Ni, Ag, Cu, and the like. The cross-sectional shape of a wire comprising the second conductor is not limited to a circular shape.

Furthermore, in a case in which weight reduction of the conductor is considered important, it is preferable that the second conductors are constructed of aluminum or aluminum alloy. Specific examples of the aluminum-based material to be used as the second conductors include ECAL, Al—Zr-based alloys, 5000 series alloys, Al—Mg—Cu—Si-based alloys, and 8000 series alloys as defined in ASTM B800-05. It is also acceptable to use plated wires obtained by plating these aluminum-based materials with Sn, Ni, Ag, Cu, and the like. The cross-sectional shape of a wire comprising the second conductor is not limited to a circular shape.

Moreover, regarding the second conductors, it is preferable that two or more kinds of second conductors having different compositions, which are selected from the group consisting of copper or the above-mentioned copper alloy and the above-mentioned aluminum or the above-mentioned aluminum alloy, are used, and the twisted wire conductor is configured to be in a mixed state between these two or more kinds of second conductors and the first conductors.

Figure 6B:
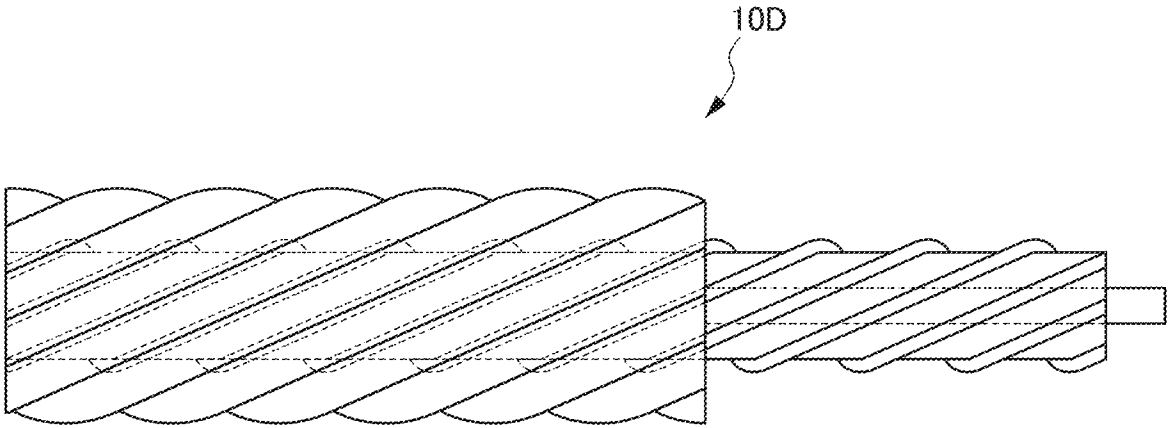
FIGS. 6(*a*) and 6(*b*) are diagrams schematically illustrating a fifth embodiment of a twisted wire conductor for an insulated electrical wire of the present invention, the fifth embodiment being the case of configuring the twisted wire conductor into a concentrically twisted wire having a 1×19 structure, FIG. 6(*a*) is a transverse cross-sectional view, and FIG. 6(*b*) is a plan view of the twisted wire conductor obtainable when the conductors positioned in the outermost layer and the conductors positioned adjacently to the inner side thereof are partially cut off so that the twisted state of the conductors constituting the twisted wire conductor can be understood.
Figure 6A:
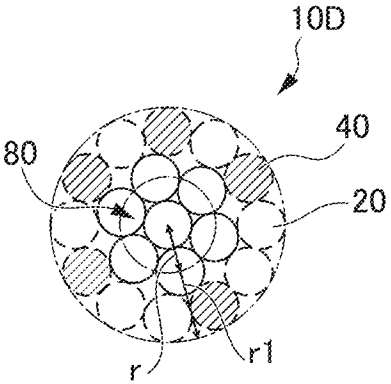

FIG. 6 is a diagram schematically illustrating a twisted wire conductor for an insulated electrical wire of a fifth embodiment, the twisted wire conductor being a concentrically twisted wire having a 1×19 structure, and FIG. 6(*a*) is a transverse cross-sectional view, while FIG. 6(*b*) is a plan view of the twisted wire conductor obtainable when the conductors positioned in the outermost layer and the conductors positioned adjacently to the inner side thereof are partially cut off so that the twisted state of the conductors constituting the twisted wire conductor can be understood.

The twisted wire conductor for an insulated electrical wire of the fifth embodiment is configured to be in a mixed state in which first conductors and second conductors are twisted together. The first conductors comprise a specific aluminum alloy having an alloy composition containing, by mass %, 0.20% to 1.80% of Mg, 0.20% to 2.00% of Si, 0.01% to 0.33% of Fe, and 0.00% to 2.00% in total of one or more elements selected from the group consisting of Cu, Ag, Zn, Ni, Co, Au, Mn, Cr, V, Zr, Ti, and Sn, with the remainder being Al and unavoidable impurities, the specific aluminum alloy having a fibrous metal structure in which crystal grains extend to be aligned in one direction, and in a cross-section parallel to the one direction, the average value of a dimension perpendicular to the longitudinal direction of the crystal grains is 400 nm or less. The second conductors comprise a metal or an alloy selected from the group consisting of copper, copper alloy, aluminum, and aluminum alloy, the metal or alloy having higher electrical conductivity than that of the first conductors. When viewed from a transverse cross-section of the twisted wire conductor, the proportion B2 occupied by the number of first conductors in the total number of first conductors and second conductors, which are positioned within a region partitioned by a virtual circle that is concentric with a circumscribed circle of the twisted wire conductor and has a radius equal to a half of the radius of the circumscribed circle, is higher than the proportion A occupied by the number of first conductors in the total number of first conductors and second conductors constituting the twisted wire conductor.

As illustrated in FIG. 6, the twisted wire conductor 10D of the fifth embodiment is constructed of first conductors 20 and second conductors 40, and when viewed from a transverse cross-section of the twisted wire conductor 10D, the proportion B2 occupied by the number of first conductors 20 in the total number of first conductors 20 and second conductors 40, which are positioned within a region 80 partitioned by a virtual circle that is concentric with a circumscribed circle of the twisted wire conductor 10D and has a radius r equal to a half of a radius r1 (r1/2) of the circumscribed circle, is higher than the proportion A occupied by the number of first conductors 20 in the total number of first conductors 20 and second conductors 40 constituting the twisted wire conductor 10D.

Here, the transverse cross-section of the twisted wire conductor 10D is a cross-section perpendicular to the longitudinal direction of the twisted wire conductor 10D. Meanwhile, in the twisted wire conductor 10D of the fifth embodiment illustrated in FIG. 6(*a*), as well as a twisted wire conductor 10E of a sixth embodiment illustrated in FIG. 7 and a twisted wire conductor 10F of a seventh embodiment illustrated in FIG. 8, which will be described below, the contour lines of the first conductors 20 and the second conductors 40 that are positioned within the region 80 are represented by solid lines, and the contour lines of the first conductors 20 and the second conductors 40 that are not positioned within the region 80 are represented by broken lines. In transverse cross-sections in arbitrary portions in the longitudinal direction of the twisted wire conductors 10D, 10E, and 10F, the proportion B2 occupied by the number of first conductors 20 in the total number of first conductors 20 and second conductors 40, which are positioned within the region 80, is always higher than the proportion A occupied by the number of first conductors 20 in the total number of first conductors 20 and second conductors 40 constituting the twisted wire conductors 10D, 10E, and 10F.

The twisted wire conductor 10D of the fifth embodiment illustrated in FIG. 6 represents the case of a concentrically twisted wire configured to have a 1×19 twist structure, in which all of nineteen conductors in total, including fourteen first conductors 20 and five second conductors 40, are twisted together in the S-twist (twist of clockwise rotation) direction at the same pitch, the concentrically twisted wire using first conductors 20 and second conductors 40 that have the same wire diameter, in which the total number of first conductors 20 positioned within the region 80 is 7, while the total number of second conductors 40 positioned within the region 80 is 0. Meanwhile, in FIG. 6(*a*), in order to distinguish the first conductors 20 and the second conductors 40, only the second conductors 40 are hatched with oblique lines.

Specifically, in the twisted wire conductor 10D of the fifth embodiment, the proportion B2 occupied by the number of first conductors 20 in the total number (7 pieces) of first conductors 20 (7 pieces), which are positioned within the region 80, and second conductors 40 (0 pieces) is 100%. Furthermore, the proportion A occupied by the number of first conductors 20 in the total number (19 pieces) of first conductors 20 (14 pieces) and second conductors 40 (5 pieces) constituting the twisted wire conductor 10D is 73.68%. Further, the proportion B2 of the number of first conductors (100%) is higher than the proportion A of the number of first conductors 20 (73.68%).

Figure 7:
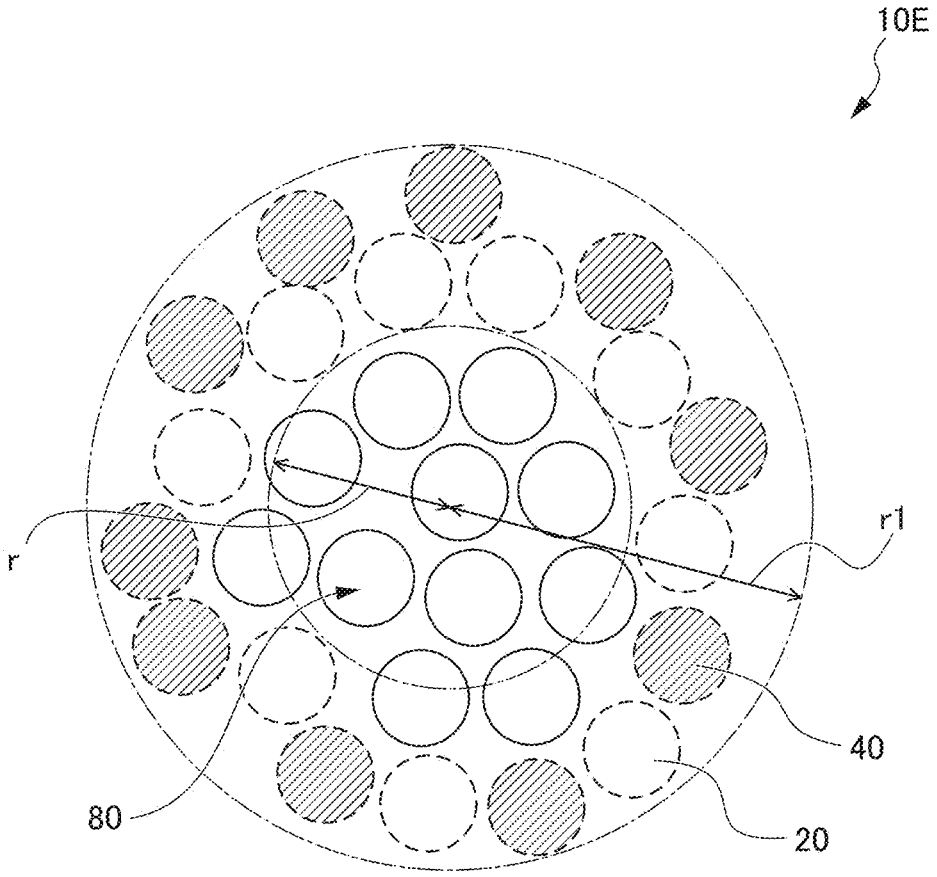
FIG. 7 is a diagram schematically illustrating a sixth embodiment of a twisted wire conductor for an insulated electrical wire of the present invention and is a transverse cross-sectional view of an assembled twisted wire formed by twisting together thirty conductors in total.

Furthermore, in the twisted wire conductor 10E of the sixth embodiment illustrated in FIG. 7, a transverse cross-sectional view of an assembled twisted wire formed by twisting together thirty conducting wires in total (first conductors and second conductors) in one direction in a bundled state is illustrated. Specifically, in the twisted wire conductor 10E of the sixth embodiment, the proportion B2 occupied by the number of first conductors 20 in the total number (11 pieces) of first conductors 20 (11 pieces) and second conductors 40 (0 pieces), which are positioned within the region 80 is 100%. Furthermore, the proportion A occupied by the number of first conductors 20 in the total number (30 pieces) of first conductors 20 (20 pieces) and second conductors 40 (10 pieces) constituting the twisted wire conductor 10E is 66.67%. Further, the proportion B2 of the number of first conductors 20 (100%) is higher than the proportion A of the number of first conductors 20 (66.67%).

Figure 8:
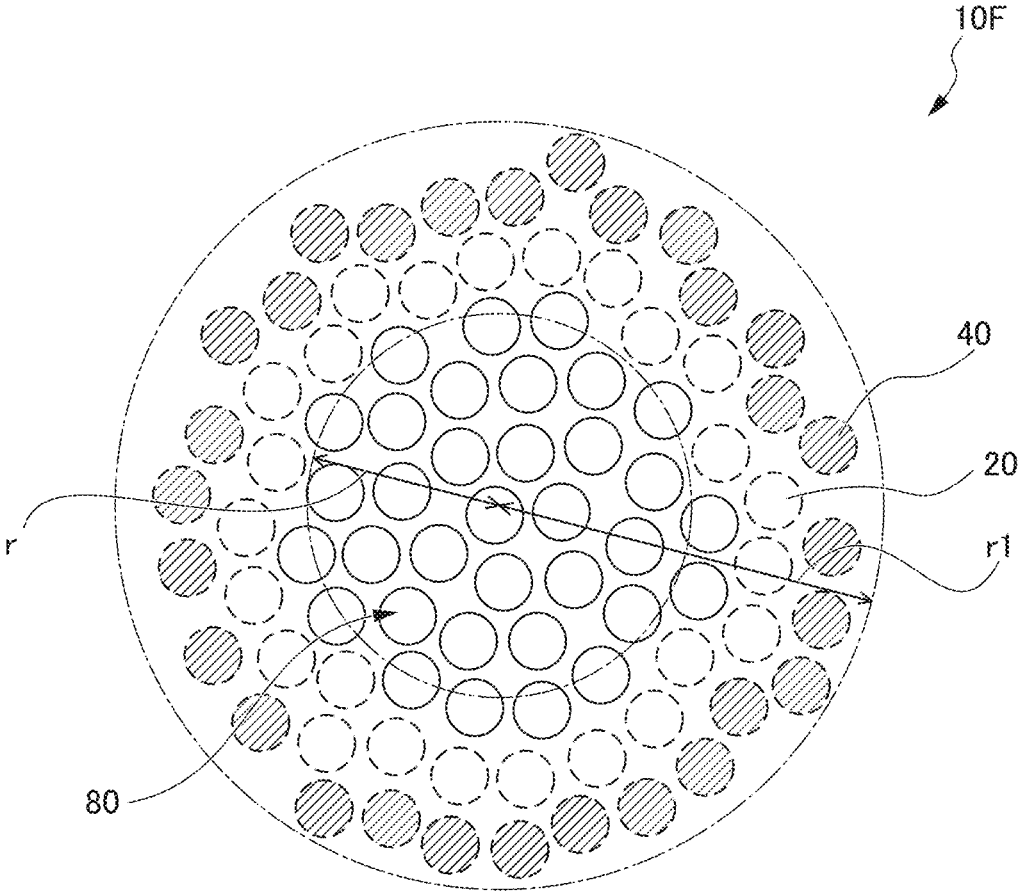
FIG. 8 is a diagram schematically illustrating a seventh embodiment of a twisted wire conductor for an insulated electrical wire of the present invention and is a transverse cross-sectional view of an assembled twisted wire formed by twisting together eighty-eight conductors in total.

Furthermore, in the twisted wire conductor 10F of the seventh embodiment illustrated in FIG. 8, a transverse cross-sectional view of an assembled twisted wire formed by twisting together eighty-eight conducting wires in total (first conductors and second conductors) in one direction in a bundled state is illustrated. Specifically, in the twisted wire conductor 10F of the seventh embodiment, the proportion B2 occupied by the number of first conductors 20 in the total number (34 pieces) of first conductors 20 (34 pieces) and second conductors 40 (0 pieces), which are positioned within the region 80, is 100%. Furthermore, the proportion A occupied by the number of first conductors 20 in the total number (88 pieces) of first conductors 20 (59 pieces) and second conductors 40 (29 pieces) constituting the twisted wire conductor 10F is 67.05%. Further, the proportion B2 of the number of first conductors 20 (100%) is higher than the proportion A of the number of first conductors 20 (67.05%).

Meanwhile, in a case in which the region 80 is partitioned so as to divide a portion of the first conductors 20 or the second conductors 40, the total number of conductors positioned within the region 80 also includes the sum of the number of first conductors and the number of second conductors, which are divided by a region 60. FIGS. 6 to 8 illustrate the twisted wire conductors 10D, 10E, and 10F, respectively, when the region 80 is partitioned so as to divide a portion of the first conductors 20.

In the twisted wire conductors 10D, 10E, and 10F of the fifth to seventh embodiments, the ratio (B2/A) of the proportion B2 occupied by the number of first conductors 20 in the total number of first conductors 20 and second conductors 40, which are positioned within the region 80 to the proportion A occupied by the number of first conductors 20 in the total number of first conductors 20 and second conductors 40 constituting the twisted wire conductor is preferably 1.50 or higher, and more preferably 1.70 or higher. As the proportion B2 of the number of first conductors 20 with respect to the proportion A of the number of first conductors 20 is higher, the bending fatigue resistance, weight reduction, and the ease of deformation (easiness in deformation) of the twisted wire conductors 10D, 10E, and 10F are enhanced. When the ratio (B2/A) is 1.50 or higher, the effect of enhancing these characteristics is sufficient.

Here, the ease of deformation means, in a case that trains an insulation coated electrical wire or a cable along a wiring path and fixes it, the ease of deforming the shape according to the shape of the path. When this characteristic is poor, it is a so-called a state of having strong repellence, and the operation of deforming a twisted wire conductor into a desired shape becomes very difficult.

In the above description, an example in which, when viewed from a transverse cross-section of a twisted wire conductor, the circumscribed circle of the twisted wire conductor is a true circle is disclosed; however, the circumscribed circle of the twisted wire conductor may be any arbitrary shape such as a semi-circular shape, an elliptical shape, or a shape resulting from arbitrary deformation of a true circle. In this case, the radius of a virtual true circle is calculated from the area of the arbitrary shape, and a virtual true circle drawn based on the radius thus calculated by taking the center of gravity of the arbitrary shape as the center, is regarded as the circumscribed circle of the twisted wire conductor.

Furthermore, in a case in which lowering of the conductor resistance and the connectivity to the copper terminal is considered important, it is preferable that the second conductors are constructed of copper or copper alloy. Specific examples of the copper-based material to be used as the second conductors include oxygen-free copper, tough pitch copper, phosphorus deoxidized copper, Cu—Ag-based alloys, Cu—Sn-based alloys, Cu—Mg-based alloys, Cu—Cr-based alloys, Cu—Mg—Zn-based alloys, and copper alloys for conductors as defined in ASTM B105-05. Furthermore, it is also acceptable to use plated wires obtained by plating these copper-based materials with Sn, Ni, Ag, Cu, and the like. The cross-sectional shape of a wire formed from the second conductors is not limited to a circular shape.

Furthermore, in a case in which weight reduction of the conductor is considered important, it is preferable that the second conductors are constructed of aluminum or aluminum alloy. Specific examples of the aluminum-based material to be used as the second conductors include ECAL, Al—Zr-based alloys, 5000 series alloys, Al—Mg—Cu—Si-based alloys, and 8000 series alloys as defined in ASTM B800-05. It is also acceptable to use plated wires obtained by plating these aluminum-based materials with Sn, Ni, Ag, Cu, and the like. The cross-sectional shape of a wire formed from the second conductors is not limited to a circular shape.

Furthermore, regarding the second conductors, it is preferable to use two or more kinds of second conductors having different compositions, which are selected from the group consisting of copper or the above-mentioned copper alloys and aluminum or the above-mentioned aluminum alloys, and to configure the twisted wire conductor to be in a mixed state between these two or more kinds of second conductors and the first conductors.

As a suitable embodiment of the present invention, it is preferable that when viewed from a transverse cross-section of the twisted wire conductor, the total cross-sectional area S1 ($mm^2$) of the first conductors 20 is in the range of 2% to 98% of the nominal cross-sectional area S ($mm^2$) of the twisted wire conductor. It is because when the total cross-sectional area S1 of the first conductors 20 is less than 2% of the nominal cross-sectional area S of the twisted wire conductor, as a twisted wire conductor, weight reduction and fatigue life characteristics cannot be obtained to a desired extent. Furthermore, when the nominal cross-sectional area S of the twisted wire conductor is more than 98%, the electrical conductivity as the twisted wire conductor is lowered, and for example, when continuous conduction for a long time period at a high current density or intermittent conduction is repeated, the amount of heat generation of the twisted wire conductor increases, so that there is a risk that the cable as a whole may undergo self-heating to a high temperature (for example, above 90° C.), while the safety aspect needs to be taken into consideration depending on the use conditions, which is therefore not preferable.

Here, the total cross-sectional area S1 ($mm^2$) of the first conductors 20 mean the sum total of the cross-sectional areas A1 of all the first conductors 20 measured, which is obtained by measuring the cross-sectional area A1 ($mm^2$) of each of the first conductors 20 constituting the twisted wire conductor. For example, when the number of first conductors 20 constituting the twisted wire conductor is m pieces, and all of these first conductors 20 have the same diameter d1 (mm), since the cross-sectional area A1 of each of the first conductors 20 is represented by $\pi(d1/2)^2$, the total cross-sectional area S1 of the first conductors 20 is represented by the following formula:

$$S1=m\times A1=m\pi(d1/2)^2$$

Furthermore, the total cross-sectional area S2 ($mm^2$) of the second conductors 40 means the sum total of the cross-sectional areas A2 of all the second conductors 40 measured, which is obtained by measuring the cross-sectional area A2 ($mm^2$) of each of the second conductors 40 constituting the twisted wire conductor. For example, when the number of first conductors 40 constituting the twisted wire conductor is n pieces, and all of these second conductors 40 have the same diameter d2 (mm), since the cross-sectional area A2 of each of the second conductors 40 is represented by $\pi(d2/2)^2$, the total cross-sectional area S2 of the second conductors 40 is represented by the following formula:

$$S2=n\times A2=n\pi(d2/2)^2$$

Furthermore, the nominal cross-sectional area S of the twisted wire conductor means the sum total of the cross-sectional areas of all the conductors (first conductors 20 and second conductors 40) constituting the twisted wire conductor, and is represented by the following formula:

$$S(mm^2)=S1(mm^2)+S2(mm^2)$$

Furthermore, it is preferable that the proportion occupied by the number of first conductors 20 in the total number of first conductors 20 and second conductors 40 constituting the twisted wire conductor is in the range of 2% to 98%. It is because when the proportion of the number of first conductors is less than 2%, weight reduction and fatigue life characteristics to a desired extent as a twisted wire conductor cannot be obtained. Furthermore, when the proportion of the number of first conductors is more than 98%, the electrical conductivity as a twisted wire conductor is lowered, and for example, when continuous conduction for a long time period at a high current density or intermittent conduction is repeatedly performed, the amount of heat generation of the twisted wire conductor increases, there is risk that the cable as a whole may undergo self-heating to a high temperature (for example, above 90° C.), while the safety aspect needs to be taken into consideration depending on the use conditions, which is therefore not preferable.

Furthermore, the diameter (wire diameter) dimensions of the first conductors 20 and the second conductors 40 may be identical or different. For example, in a case in which the fatigue life is considered important, it is preferable that the first conductors 20 and the second conductors 40 have the same diameter dimension. Furthermore, in a case in which reduction of gaps formed between a conductor and a conductor, which constitute the twisted wire conductor, and between a conductor and the coating, is considered important, it is preferable that the first conductors 20 and the second conductors 40 have different diameter dimensions.

Such a twisted wire conductor for an insulated electrical wire can be realized by controlling the alloy composition and the production processes in combination. Meanwhile, FIG. 2, FIG. 3, and FIG. 6 illustrate examples of a twisted wire conductor configured to have a 1×19 twist structure by twisting together the predetermined number of first conductors 20 and the predetermined number of second conductors 40 in the S-twist direction (twist of clockwise rotation) at the same pitch; however, in the present invention, it is acceptable as long as the twisted wire conductor is configured to be in a mixed state in which the first conductors 20 and the second conductors 40 are twisted together, and conditions such as the type of the twisted wire (for example, an assembled twisted wire, a concentrically twisted wire, or a rope twisted wire), the twist pitch (for example, the pitches of the conductors positioned in the inner layer and the conductors positioned in the outer layer are identical or different), the twist direction (for example, S-twist, Z-twist, crossover twist, or parallel twist), the twist structure (1×7, 1×19, 1×37, 7×7, or the like), and the wire diameter (for example, 0.07 to 2.00 mmϕ) are not limited and can be appropriately designed and modified according to the use applications for which the twisted wire conductor is used. For example, various twist structures are described in "600 V Rubber cabtire cable" of JIS C3327:2000.

Figure 9A:
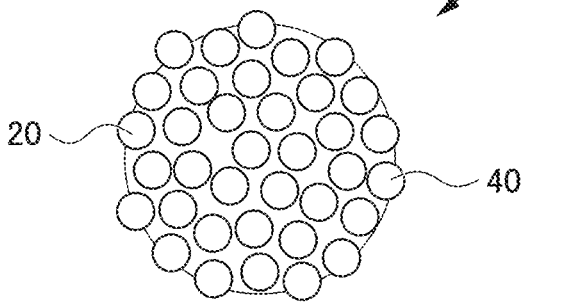
FIGS. 9(*a*) to 9(*c*) are transverse cross-sectional views respectively schematically illustrating eighth to tenth embodiments of the twisted wire conductor for an insulated electrical wire of the present invention, the twisted wire conductor of the eighth embodiment illustrated in FIG. 9(*a*) represents the case of configuring the twisted wire conductor into an assembled twisted wire, the twisted wire conductor of the ninth embodiment illustrated in FIG. 9(*b*) represents the case of configuring the twisted wire conductor into a concentrically twisted wire having a 1×37 structure, and the twisted wire conductor of the tenth embodiment illustrated in FIG. 9(*c*) represents the case of configuring the twisted wire conductor into a rope twisted wire having a 7×7 structure.
Figure 9B:
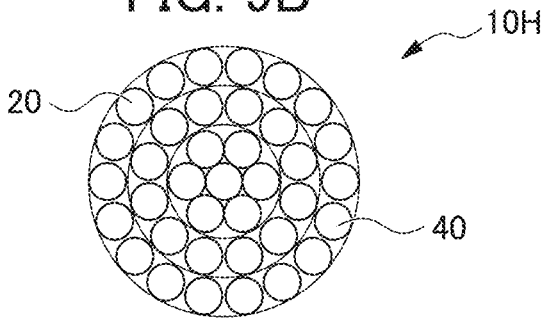
Figure 9C:
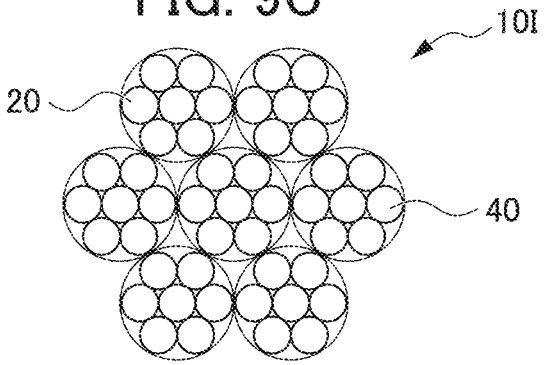

Regarding the twist structure of the twisted wire conductor, for example, FIG. 9(*a*) illustrates a case in which an assembled twisted wire is configured by twisting together thirty-six conductors (first conductors and second conductors) in total in one direction in a bundled state; FIG. 9(*b*) illustrates a case in which a concentrically twisted wire having a 1×37 structure is configured to include thirty-seven conductors (first conductors and second conductors) in total, with one conductor disposed at the center and six, twelve, and eighteen conductors twisted together and then disposed in sequence around the one conductor; and FIG. 9(*c*) illustrates a case in which a rope twisted wire having a 7×7 structure is configured to include seven conductors (first conductors and second conductors), with seven twisted wires having a 1×7 structure, in which one conductor is disposed at the center and six conductors are twisted together around this conductor, being bundled and twisted together. Meanwhile, in FIGS. 9(*a*) to 9(*c*), both the first conductors and the second conductors are disposed; however, the two are presented without distinguishing between them.

Furthermore, the dispositional relationship of the first conductors 20 and the second conductors 40 constituting the twisted wire conductor 10 is not particularly limited, and for example, the first conductors 20 may be disposed on the internal side of the twisted wire conductor 10 or on the external surface side thereof, while it is also acceptable that the first conductors 20 are dispersed on the internal side and the outer surface side of the twisted wire conductor 10 and randomly disposed. Furthermore, in the twisted wire conductors 10A, 10B, and 10C, it is desirable that in a mixed state in which the first conductors 20 and the second conductors 40 are twisted together, the proportion B1 occupied by the number of first conductors in the total number of first conductors and second conductors, which are positioned in the outermost layer of the twisted wire conductor, is configured to be higher than the proportion A occupied by the number of first conductors in the total number of first conductors and second conductors constituting the twisted wire conductor. Furthermore, in the twisted wire conductors 10D, 10E, and 10F, it is desirable that in a mixed state in which the first conductors 20 and the second conductors 40 are twisted together, the proportion B2 occupied by the number of first conductors in the total number of first conductors and second conductors, which are positioned within a region partitioned by a virtual circle that is concentric with a circumscribed circle of the twisted wire conductor and has a radius equal to a half of the radius of the circumscribed circle, is configured to be higher than the proportion A occupied by the number of first conductors in the total number of first conductors and second conductors constituting the twisted wire conductor.

Furthermore, the insulated electrical wire (not illustrated in the diagrams) and cord (not illustrated in the diagrams) of the present invention each comprise the above-described twisted wire conductor and an insulating coating covering the outer periphery of the twisted wire conductor. The insulating coating covers the outer periphery of the twisted wire conductor along the axial line in the longitudinal direction of the twisted wire conductor. The insulating coating is formed from a known coating used for general insulated electrical wires and cords, for example, an insulator such as rubber or a resin. Here, the difference between an insulated electrical wire and a cord is that an insulated electrical wire does not have flexibility, while a cord has flexibility.

In the insulating electrical wire and cord comprising the twisted wire conductors 10A, 10B, and 10C, the above-described ratio (B1/A) is preferably 1.50 or higher, and more preferably 1.70 or higher. As the proportion B1 of the number of first conductors 20 with respect to the proportion A of the number of first conductors 20 is higher, the copper damage resistance of the insulated electrical wire and the cord is enhanced. When the ratio (B1/A) is 1.50 or higher, the effect of enhancing the copper damage resistance is sufficient.

Here, the copper damage resistance refers to the resistance to copper damage to an insulating coating that constitutes an insulated electrical wire and a cord. Under copper damage to an insulating coating, the insulating coating is deteriorated as a result of copper ions in the conductor that is in contact with the insulating coating penetrate into the insulating coating. Therefore, as in the case of the twisted wire conductors 10A, 10B, and 10C, the existence ratio of the copper-based conductor material that is in contact with the insulating coating decreases because a large number of first conductors formed from a specific aluminum alloy are disposed in the outermost layer of the twisted wire conductor, and therefore, the copper damage resistance of the insulating coating is enhanced. Accordingly, the insulating coating can cover the conductor stably for a long time period.

[Method for Producing Twisted Wire Conductor for Insulated Electrical Wire]

<Method for Producing First Conductor>

Next, an example of a method for producing a first conductor that constitutes the twisted wire conductor for an insulated electrical wire according to the present invention will be described below.

The specific aluminum alloy material of the first conductor that constitutes such a twisted wire conductor for an insulated electrical wire according to an embodiment of the present invention has a feature of attempting an increase in the fatigue life particularly by introducing crystal grain boundaries into the interior of an Al—Mg—Si—Fe-based alloy at a high density. Therefore, this method is significantly different from the conventional method of precipitating and hardening Mg—Si compounds, which has been generally carried out for aluminum alloy materials, in view of the approach to the increase in the fatigue life.

In a preferred method for producing the specific aluminum alloy material of the first conductor, the aluminum alloy material having a predetermined alloy composition is not subjected to an aging precipitation heat treatment [0], but is subjected to cold wire drawing [1] at a working ratio of 4 or higher as final wire drawing. Furthermore, if necessary, low temperature annealing [2] may also be carried out after the cold wire drawing [1]. This will be explained in detail below.

Usually, when a stress of deformation is applied to a metal material, crystal slip occurs as an elementary process for the deformation of metal crystals. As a metal material is more likely to have such crystal slip, the metal material can be said to have a smaller stress required for deformation and lower strength. Therefore, in regard to strength increase in a metal material, it is important to suppress the crystal slip occurring within the metal structure. As a factor for inhibiting such crystal slip, the presence of crystal grain boundaries within the metal structure may be mentioned, and such crystal grain boundaries can prevent the crystal slip from propagating within the metal structure when a stress of deformation is applied to the metal material. As a result, the strength of the metal material is increased.

Therefore, with regard to strength increase in a metal material, it is speculated that it is desirable to introduce crystal grain boundaries into the metal structure at a high density. Here, regarding the mechanism for forming crystal grain boundaries, for example, splitting of metal crystals concomitant to deformation of the metal structure may be considered. Usually, the interior of a polycrystalline material is in a complicated multiaxial state in terms of the stress state, due to the difference in the orientation between adjacent crystal grains or to the spatial distribution of strain between the vicinity of the surface layer that is in contact with working tools and the bulk interior. Under the influence of these, crystal grains that are in a single orientation before deformation undergo splitting into a plurality of orientations concomitantly with deformation, and crystal grain boundaries are formed between the split crystals.

However, the crystal grain boundaries thus formed are structures different from the conventional closest packed atomic arrangement of twelve coordinates and have interfacial energy. Accordingly, it is speculated that in a conventional metal structure, when the crystal grain boundaries have a certain level of density or higher, the increased internal energy serves as the driving force, and dynamic or static recovery and recrystallization occurs. Therefore, usually, even if the amount of deformation is increased, increase and decrease of the crystal grain boundaries occur simultaneously, and therefore, the grain boundary density reaches a saturated state.

Figure 10:
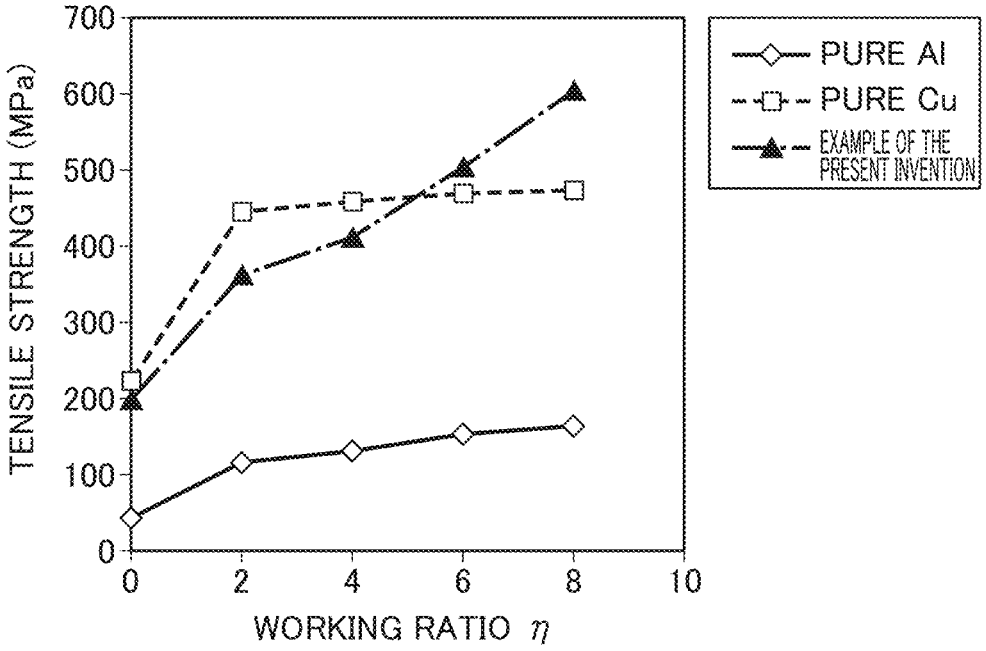
FIG. 10 is a graph showing the relationship between the working ratio $\eta$ for cold working and the tensile strength (MPa) for the specific aluminum alloy material (invented example) used for the first conductor constituting the twisted wire conductor for an insulated electrical wire according to the present invention, a pure aluminum material, and a pure copper material.

Such a phenomenon also coincides with the relationship between the working ratio and the tensile strength (MPa) in a pure aluminum material or a pure copper material, which are conventional metal structures. FIG. 10 shows a graph plotting the relationship between the working ratio and the tensile strength in a pure aluminum material, a pure copper material, and the specific aluminum alloy material of an example of the present invention.

As shown in FIG. 10, with regard to a pure aluminum material and a pure copper material, which are general metal structures, in a region in which the working ratio $\eta$ is relatively low ($\eta \leq 2$), an increase in the tensile strength is recognized as the working ratio $\eta$ increases; however, in a region in which the working ratio is high ($\eta > 2$), there is a tendency that the effect of increasing the tensile strength is decreased and saturated. Here, it is contemplated that the working ratio $\eta$ corresponds to the amount of deformation that is applied to the above-mentioned metal structure, and the saturation of the tensile strength corresponds to the saturation of the grain boundary density.

In contrast, it was found that in the specific aluminum alloy material that is used for the first conductors of the twisted wire conductor of the present invention, the tensile strength consistently continues to increase even in a region in which the working ratio $\eta$ is high ($\eta > 2$). It is speculated that this is because when the first conductors (specific aluminum alloy material) have the above-described alloy composition, particularly when predetermined amounts of Mg and Si are subjected to compound addition, even if the crystal grain boundaries in the metal structure reach a certain level of density or higher, an increase in the internal energy can be suppressed. It is speculated that as a result, recovery or recrystallization within the metal structure can be prevented, and the crystal grain boundaries in the metal structure can be effectively increased.

The mechanism for such strength increase brought by compound addition of Mg and Si is not necessarily clearly understood; however, it is speculated that the mechanism is based on the following: (i) by using Mg atoms having a large atomic radius and Si atoms having a small atomic radius in combination for Al atoms, the respective atoms are always densely packed (arranged) in the aluminum alloy material; and (ii) by incorporating divalent Mg and tetravalent Si to co-exist with trivalent Al atoms, a trivalent state can be formed in the entirety of the aluminum alloy material, and stability in terms of valency can be attempted, so that an increase in the internal energy concomitant to working can be effectively suppressed.

Therefore, in the method for producing the first conductors of the twisted wire conductor of the present invention, the degree of for the cold wire drawing [1] is adjusted to 4 or higher. In particular, when wire drawing with a high working ratio is carried out, splitting of metal crystals concomitant to the deformation of the metal structure can be accelerated, and crystal grain boundaries can be incorporated at a high density into the interior of the specific aluminum alloy material. As a result, the grain boundaries of the specific aluminum alloy material are reinforced, and the strength and the fatigue life are enhanced to a large extent. Such a working ratio $\eta$ is preferably adjusted to 5 or higher, more preferably 6 or higher, and even more preferably 7 or higher. Furthermore, the upper limit of the working ratio $\eta$ is not particularly defined, and the working ratio is usually 15 or less; however, in a case in which reducing the frequency of breaking of wire during twisting is considered important, it is preferable to adjust the working ratio $\eta$ to 7.6 or less.

Meanwhile, the working ratio $\eta$ is represented by the following Formula (1), when the cross-sectional area of the first conductor before wire drawing is designated as s1, and the cross-sectional area of the first conductor after wire drawing is designated as s2 (s1>s2):

$$\text{Working ratio(dimensionless): } \eta = \ln(s1/s2) \quad (1)$$

Meanwhile, the cross-sectional area s2 of the first conductor after wire drawing means, in a case in which a plurality of dies having different hole diameters is used to perform wire drawing (drawing or extrusion) of several times, the cross-sectional area of the first conductor after final wire drawing.

Furthermore, the general conditions for working such as described above (type of the lubricant oil, working rate, heat generation for working, and the like) may be appropriately adjusted to known ranges.

The aluminum alloy material is not particularly limited as long as the material has the alloy composition described above, and for example, an extruded material, a cast ingot material, a hot rolled material, or a cold rolled material can be appropriately selected and used according to the purpose of use.

Furthermore, in the present invention, an aging precipitation heat treatment [0] that has been traditionally carried out before cold wire drawing [1] is not carried out. Such an aging precipitation heat treatment [0] usually involves acceleration of precipitation of Mg—Si compounds by maintaining the aluminum alloy material at 160° C. to 240° C. for 1 minute to 20 hours. However, in a case in which the aluminum alloy material is subjected to such an aging precipitation heat treatment [0], cold wire drawing [1] based on a high working ratio such as described above cannot be carried out because working splitting occurs in the interior of the material. Furthermore, in a case in which the aging temperature is a high temperature, since the material is in an over-aged state, working splitting may not occur even after cold wire drawing [1] based on a high working ratio such as described above; however, in this case, Mg and Si are discharged as Mg—Si compounds from the Al parent phase, and the stability of grain boundaries is markedly deteriorated.

In the present invention, for the purpose of stabilizing fine crystal grains formed by plastic working, it is preferable that cold wire drawing [1] is carried out by wire drawing for several times, for example, four or more times, and at the same time, a stabilization heat treatment for 2 to 10 hours at 50° C. to 80° C. is carried out between wire drawing processes. That is, a treatment set composed of cold working [1] with a working ratio of 1.2 or less, and a stabilization heat treatment [2] at a treatment temperature of 50° C. to 80° C. for a retention time of 2 to 10 hours is carried out as one set, four or more sets are carried out repeatedly in this order, and the total working ratio of the cold working [1] is adjusted to 4.0 or higher. Furthermore, low temperature annealing [2] may be carried out after the cold wire drawing [1]. In the case of performing low temperature annealing [2], the treatment temperature is set to 110° C. to 160° C. In a case in which the treatment temperature of the low temperature annealing [2] is below 110° C., it is difficult to obtain effects such as described above, and when the treatment temperature is above 160° C., growth of crystal grains occurs as a result of recovery or recrystallization, while strength is decreased. Furthermore, the retention time of the low temperature annealing [2] is preferably 1 to 48 hours. Meanwhile, the general conditions for such a heat treatment can be appropriately regulated by means of the type or amount of unavoidable impurities, and solid-solutioning and precipitation state of the aluminum alloy material. Meanwhile, an intermediate heat treatment in a conventional production method is intended to lower the deformation resistance by recrystallizing the metal material, and to reduce the load of working machines or to reduce abrasion of tools that come into contact with the material, such as a die and a capstan; however, in such an intermediate heat treatment, fine crystal grains as in the case of the first conductors constituting the twisted wire conductor of the present invention are not obtained.

Furthermore, in the present invention, as explained above, the aluminum alloy material is subjected to working with a high working ratio by means of drawing using a die, or the like. Therefore, consequently, a long aluminum alloy material is obtained. On the other hand, in conventional methods for producing the aluminum alloy material, such as powder sintering, compression twisting, high pressure torsion (HPT), forging, and equal channel angular pressing (ECAP), it is difficult to obtain such a long aluminum alloy material. Such a specific aluminum alloy material that is used for the first conductors constituting the twisted wire conductor of the present invention is preferably produced to have a length of 10 m or more. Meanwhile, the upper limit of the length of the first conductors (specific aluminum alloy material) at the time of production is not specially set; however, in consideration of workability or the like, it is preferable to adjust the length to 6,000 m or less.

Furthermore, with regard to the specific aluminum alloy material of the first conductors, since it is effective to increase the degree of for the refinement of crystal grains as explained above, it is easier to realize the configuration of the present invention as the diameter is made finer.

Particularly, the wire diameter of the first conductors is preferably 1 mm or less, more preferably 0.5 mm or less, even more preferably 0.1 mm or less, and particularly preferably 0.07 mm or less. Meanwhile, the upper limit is not particularly set; however, it is preferable that the wire diameter is 30 mm or less. One advantage of the first conductors used for the present invention is that the first conductors can be used after being made thin as a solid wire.

Furthermore, as explained above, the first conductors (specific aluminum alloy material) are processed to be thin; however, a plurality of such first conductors can be prepared and joined to be made thick, and then the resulting product can be used for intended use applications. Meanwhile, regarding the method of joining, any known method can be used, and examples include pressure welding, welding, joining with an adhesive, and friction stir joining. Furthermore, a plurality of first conductors can be bundled and twisted together with the second conductors, and can be used as a twisted wire conductor for intended use applications. Meanwhile, the above-described process of low temperature annealing [2] may be carried out after a specific aluminum alloy material that has been subjected to the cold wire drawing [1] is subjected to working based on joining or twisting together.

<Structural Feature of Specific Aluminum Alloy (Material) of First Conductor>

In the first conductors (specific aluminum alloy material) produced according to the production method such as described above, crystal grain boundaries are introduced into the metal structure at a high density. Such first conductors have a fibrous metal structure in which crystal grains extend to be aligned in one direction, and have a feature such that in a cross-section parallel to the one direction, the average value of a dimension perpendicular to the longitudinal direction of the crystal grains is 400 nm or less. Such first conductors (specific aluminum alloy material) can exhibit particularly high fatigue life characteristics by having an unprecedented unique metal structure.

The metal structure of the first conductors (specific aluminum alloy material) is a fibrous structure, and crystal grains having an elongated shape are aligned in one direction to be in a state of extending in a fibrous form. Here, the term "one direction" corresponds to the direction of working for the aluminum alloy material and specifically means the direction of wire drawing. Furthermore, the first conductors (specific aluminum alloy material) exhibit particularly excellent fatigue life characteristics particularly against a tensile stress parallel to such a direction of working (direction of wire drawing).

Furthermore, the above-described one direction preferably corresponds to the longitudinal direction of the first conductors (specific aluminum alloy material). That is, usually, as long as the aluminum alloy material is not individualized at a dimension shorter than the dimension perpendicular to the direction of working, the direction of working corresponds to the longitudinal direction of the aluminum alloy material.

Furthermore, in a cross-section parallel to the above-described one direction, the average value of the dimension perpendicular to the longitudinal direction of the crystal grains is 400 nm or less, more preferably 220 nm or less, even more preferably 170 nm or less, and particularly preferably 120 nm or less. In such a fibrous metal structure in which crystal grains having a small diameter (dimension perpendicular to the longitudinal direction of the crystal grains) extend in one direction, the crystal grain boundaries are formed at a high density, and according to such a metal structure, crystal slip due to deformation can be effectively inhibited, and unprecedented excellent fatigue life characteristics can be realized. Meanwhile, the lower limit of the average value of the dimension perpendicular to the longitudinal direction of the crystal grains is not particularly limited; however, from the viewpoint of workability in wire twisting, it is preferable to adjust the average value to 50 nm or more.

Furthermore, the dimension in the longitudinal direction of the crystal grains is not particularly specified; however, the dimension is preferably 1,200 nm or more, more preferably 1,700 nm or more, and even more preferably 2,200 nm or more. Furthermore, the aspect ratio of the crystal grains is preferably greater than 10, and more preferably 20 or greater. Meanwhile, the upper limit of the aspect ratio of the crystal grains is not particularly limited; however, from the viewpoint of workability in wire twisting, it is preferable to adjust the aspect ratio to 30,000 or less.

<Method for Producing Second Conductor>

The second conductor is constructed of a metal or an alloy selected from the group consisting of copper, copper alloy, aluminum, and aluminum alloy. Such a second conductor formed using each of copper, copper alloy, aluminum, and the aluminum alloy may be produced according to a conventional method.

[Bending Fatigue Resistance]

The bending fatigue resistance can be evaluated by subjecting a twisted wire conductor to predetermined repeated bending by a reversed bending fatigue test according to JIS Z 2273-1978 and a repeated bending test according to JIS C 3005:2014. The twisted wire conductor according to the present invention has a long fatigue life compared to a twisted wire conductor composed only of general-purpose EC-AL wires, or to a twisted wire conductor composed only of general-purpose annealed copper wires, and excellent bending fatigue resistance is obtained.

[Electrical Conductivity]

The electrical conductivity can be measured by a Wheatstone Bridge method according to JIS C 3005:2014. The twisted wire conductor according to the present invention acquires lower conductor resistance compared to a twisted wire conductor composed only of first conductors formed from fine crystals.

[Weight of Twisted Wire Conductor]

The weight of the twisted wire conductor was evaluated by measuring the weight in a twisted wire conductor state before attaching a coating, using a gravimeter.

[Non-Easiness in Deformation]

Bending of a twisted wire conductor was carried out at a diameter that was 5 to 10 times the diameter of the cable with a tool conforming to JIS C 3005:2014, the amount of permanent strain remaining after springing back was measured, and thus the non-easiness in deformation was evaluated.

[Easiness in Deformation]

A twisted wire conductor is subjected to 90° bending by conforming to JIS C 3005:2014. At that time, the ease in deformation of the twisted wire conductor can be evaluated by measuring the required force.

<Uses of Twisted Wire Conductor for Insulated Electrical Wire, Insulated Electrical Wire, and Cord of Present Invention>

The twisted wire conductor, insulated electrical wire, and cord of the present invention can be used in all use applications where iron-based materials, copper-based materials, and aluminum-based materials are used. Specifically, examples include conductive members such as cables and electrical wires, which include the above-described insulated electrical wire or cord; and a sheath (protective exterior coating) providing an insulating coating so as to include the insulated electrical wire or the cord, for example, power wires such as an overhead transmission line, an OPGW, an underground transmission line, and a submarine cable; electrical wires for communication such as a telephone cable and a coaxial cable; electrical wires for machines, such as a cable for a wired drone, a cabtire cable, a charging cable for EV/HEV, a twisted cable for an offshore wind power system, an elevator cable, an umbilical cable, a robot cable, an overhead wire for train, and a trolley wire; and electrical wires for transportation such as a wire harness for automobiles, an electrical wire for ships, and an electrical wire for aircrafts. Particularly, the twisted wire conductor, insulated electrical wire, and cord are optimal for use in cables and electrical wires, to which a pulling or bending force or a large number of times of force with a small strain amount caused by vibration acts repeatedly, such as a cabtire cable, an elevator cable, and a high-voltage cable for vehicles. As such, the twisted wire conductor, insulated electrical wire, and cord of the present invention are optimal for use in movable cables that are subjected to large deformation of being pulled or bent, or in restraining cables that are subjected to vibration from a power source such as an engine or a motor or from the outside.

Thus, embodiments of the present invention have been described; however, the present invention is not intended to be limited to the above-described embodiments, and the present invention includes all embodiments included in the concept and the claims of the present invention, and can be modified into a variety within the claims of the present invention.

EXAMPLES

Next, in order to further clarify the effects of the present invention, Examples and Comparative Examples will be described; however, the present invention is not intended to be limited to these Examples.

Examples 1-1 to 1-30

First, each of rod materials having a diameter of 10 mmϕ and having the alloy compositions indicated in Table 1 was prepared, and the initial wire diameter was adjusted using each of the rod materials so as to satisfy (the working ratio of) the production conditions and the final element wire diameters described in Table 1. That is, first conductors (specific aluminum alloy wire material) having the wire diameters indicated in Table 1 were produced by adjusting the diameters by die drawing, swaging, rolling, and the like, and then performing annealing. Furthermore, second conductors were produced, according to conventional methods, as various wire materials having the same wire diameters as the first conductors indicated in Table 1 using any metal or alloy selected from the group consisting of copper, copper alloy, aluminum, and aluminum alloy. Then, twisted wire conductors having the twist structure as indicated in Table 1 were produced by twisting together the first conductors of the installation number indicated in Table 1 and the second conductors of the installation number indicated in Table 1. At this time, the proportion of the total cross-sectional area S1 of the first conductors with respect to the nominal cross-sectional area S of the twisted wire conductor is presented in Table 1. The alloy composition, metal structure, and production conditions of the first conductors (specific aluminum alloy material) and the type of the material of the second conductor are also presented in Table 1.

Comparative Example 1-1

Comparative Example 1-1 is an example of producing a twisted wire conductor having the same twist structure as that of Example 1-1 by a method similar to Example 1-1, without using second conductors. At this time, the total cross-sectional area S1 of the first conductors was 100% of the nominal cross-sectional area S of the twisted wire conductor.

Comparative Example 1-2

Comparative Example 1-2 is an example of producing a twisted wire conductor having the same twist structure as that of Example 1-17 by a method similar to Example 1-17, using a rod material for first conductor, in which the contents of Mg and Si were less than the appropriate ranges of the present invention. At this time, the total cross-sectional area S1 of the first conductors was 50% of the nominal cross-sectional area S of the twisted wire conductor.

Comparative Example 1-3

In Comparative Example 1-3, a rod material for first conductor in which the contents of Mg and Si were more than the appropriate ranges of the present invention was used, and production of the first conductor was attempted under production conditions K; however, since breaking of wire occurred many times, the operation was stopped.

Comparative Example 1-4

Comparative Example 1-4 is an example of producing a twisted wire conductor having the same twist structure as that of Example 1-17 by a method similar to Example 1-17, except that a rod material for first conductor, which does not contain Fe, was used, and the twisted wire conductor was produced under production conditions A. At this time, the total cross-sectional area S1 of the first conductors was 50% of the nominal cross-sectional area S of the twisted wire conductor, and the average value of a dimension perpendicular to the longitudinal direction of the crystal grains was 430 nm.

Comparative Example 1-5

In Comparative Example 1-5, a rod material for first conductor in which the Fe content was more than the appropriate range of the present invention was used, and production of the first conductor was attempted under production conditions K; however, since breaking of wire occurred many times, the operation was stopped.

Comparative Example 1-6

In Comparative Example 1-6, a rod material for first conductor in which the total content of Cu and Cr was more than the appropriate range of the present invention was used, and production of the first conductor was attempted under production conditions K; however, since breaking of wire occurred many times, the operation was stopped.

Comparative Example 1-7

Comparative Example 1-7 is an example of producing a twisted wire conductor having the same twist structure as that of Example 1-17 by a method similar to Example 1-17, except that the first conductors were produced under production conditions I. At this time, the total cross-sectional area S1 of the first conductors was 50% of the nominal cross-sectional area S of the twisted wire conductor, and the average value of a dimension perpendicular to the longitudinal direction of the crystal grains was 450 nm.

Comparative Example 1-8

In Comparative Example 1-8, a rod material for first conductor having the same composition as that of Example 1-1 was used, and production of the first conductors was attempted under production conditions J; however, since breaking of wire occurred many times, the operation was stopped.

Comparative Example 1-9

Comparative Example 1-9 is an example of producing a twisted wire conductor having the same twist structure as that of Example 1-25 by a method similar to Example 1-25, without using the second conductors. At this time, the total cross-sectional area S1 of the first conductors was 100% of the nominal cross-sectional area S of the twisted wire conductor.

Conventional Example 1-1

Conventional Example 1-1 is an example of producing a twisted wire conductor having the same twist structure as that of Example 1-1, except that the twisted wire conductor was constructed only of second conductors formed from a pure copper material (tough pitch copper), without using the first conductor. At this time, the total cross-sectional area S1 of the first conductors was 0% of the nominal cross-sectional area S of the twisted wire conductor.

Conventional Example 1-2

Conventional Example 1-2 is an example of producing a twisted wire conductor having the same twist structure as that of Example 1-15, except that the twisted wire conductor was constructed only of second conductors formed from a pure aluminum material (EC-Al material), without using the first conductors. At this time, the total cross-sectional area S1 of the first conductors was 0% of the nominal cross-sectional area S of the twisted wire conductor.

Conventional Example 1-3

Conventional Example 1-3 is an example of producing a twisted wire conductor having the same twist structure as that of Example 1-25, except that the twisted wire conductor was constructed only of second conductors formed from a pure copper material (tough pitch copper), without using the first conductors. At this time, the total cross-sectional area S1 of the first conductors was 0% of the nominal cross-sectional area S of the twisted wire conductor.

Conventional Example 1-4

Conventional Example 1-4 is an example of producing a twisted wire conductor having the same twist structure as that of Example 1-28, except that the twisted wire conductor was constructed only of second conductors formed from a pure aluminum material (EC-Al material), without using the first conductors. At this time, the total cross-sectional area S1 of the first conductors was 0% of the nominal cross-sectional area S of the twisted wire conductor.

Meanwhile, production conditions A to K for the first conductors as indicated in Table 1 were specifically as follows.

<Production Conditions A>

A prepared rod material was subjected to five sets of a treatment of performing cold working [1] at a working ratio of 1.1 and a stabilization heat treatment [2] for 6 hours at 65° C. in sequence (hereinafter, referred to as treatment set A) (total working ratio of cold working [1]: 5.5). Low temperature annealing [2] was not performed.

<Production Conditions B>

Production was carried out under the same conditions as production conditions A, except that the treatment set A was performed six times.

<Production Conditions C>

Production was carried out under the same conditions as production conditions A, except that the treatment set A was performed seven times.

<Production Conditions D>

Production was carried out under the same conditions as production conditions A, except that the treatment set A was performed nine times.

<Production Conditions E>

A prepared rod material was subjected to four sets of a treatment of performing cold working [1] at a working ratio of 1.1 and a stabilization heat treatment [2] for 6 hours at 65° C. in sequence (hereinafter, referred to as treatment set A) (total working ratio of cold working [1]: 4.4). Subsequently, low temperature annealing [3] was performed under the conditions of 150° C. and 24 hours.

<Production Conditions F>
Production was carried out under the same conditions as production conditions E, except that the treatment set A was performed five times (total working ratio of cold working [1]: 5.5).
<Production Conditions G>
Production was carried out under the same conditions as production conditions E, except that the treatment set A was performed six times (total working ratio of cold working [1]: 6.6).
<Production Conditions H>
Production was carried out under the same conditions as production conditions E, except that the treatment set A was performed nine times (total working ratio of cold working [1]: 9.9).
<Production Conditions I>
Production was carried out under the same conditions as production conditions A, except that the working ratio of cold wire drawing [1] was adjusted to 3.5.
<Production conditions J>
A prepared rod material was subjected to an aging precipitation heat treatment [0] at a treatment temperature of 180° C. and a retention time of 10 hours, and subsequently cold wire drawing [1] was performed; however, since breaking of wire occurred many times, the operation was stopped.
<Production Conditions K>
A prepared rod material was subjected to cold wire drawing [1]; however, since breaking of wire occurred many times, the operation was stopped.

Examples 2-1 to 2-24

First, various rod materials having a diameter of 10 mmϕ and having the alloy compositions indicated in Table 3 were prepared, and the initial wire diameters were adjusted using the various rod materials so as to satisfy (the working ratio of) the production conditions and the final element wire diameters described in Table 3. That is, first conductors (specific aluminum alloy wire material) having the wire diameters indicated in Table 3 were produced by adjusting the diameters by die drawing, swaging, rolling, and the like, and then performing annealing. Furthermore, second conductors were produced, according to conventional methods, as various wire materials having the same wire diameters as the first conductors indicated in Table 3 using any metal or alloy selected from the group consisting of copper, copper alloy, aluminum, and aluminum alloy. Then, twisted wire conductors having the twist structure as indicated in Table 3 were produced by twisting together the first conductors of the installation number indicated in Table 3 and the second conductors of the installation number indicated in Table 3. At this time, the proportion A occupied by the number of first conductors in the total number of first conductors and second conductors constituting the twisted wire conductor, the proportion B1 occupied by the number of first conductors in the total number of first conductors and second conductors, which are positioned in the outermost layer, and the ratio (B1/A) of the proportion B1 of the first conductors to the proportion A of the first conductors are respectively presented in Table 3. The alloy composition, metal structure, and production conditions for the first conductors (specific aluminum alloy material), and the type of the material of the second conductors are also presented in Table 3. The remainder of the alloy composition of the first conductors is Al and unavoidable impurities.

Comparative Examples 2-1 to 2-4

Comparative Examples 2-1 to 2-4 are examples of producing twisted wire conductors having the same twist structure as that of Example 2-1 in the same manner as in Example 2-1 by using first conductors and second conductors having the alloy compositions indicated in Table 3 and twisting together the first conductors and the second conductors, except that the proportion B1 of the number of first conductors is lower than the proportion A of the number of first conductors.

Comparative Example 2-5

Comparative Example 2-5 is an example of producing a twisted wire conductor having the same twist structure as that of Example 2-1 by a method similar to Example 2-1, except that the twisted wire conductor was constructed only of first conductors having the alloy composition indicated in Table 3, without using the second conductor. At this time, the proportion A of the number of first conductors and the proportion B1 of the number of first conductors were respectively 100%, and the ratio (B1/A) was 1.00.

Comparative Examples 2-6 to 2-9

Comparative Examples 2-6 to 2-9 are examples of producing twisted wire conductors having the same twist structure as that of Example 2-21 in the same manner as in Example 2-21 by using first conductors and second conductors having the alloy compositions indicated in Table 3 and twisting the first conductors and the second conductors, except that the proportion B1 of the number of first conductors is lower than the proportion A of the number of first conductors.

Comparative Example 2-10

Comparative Example 2-10 is an example of producing a twisted wire conductor having the same twist structure as that of Example 2-21 by a method similar to Example 2-21, except that the twisted wire conductor was constructed only of first conductors having the alloy composition indicated in Table 3, without using the second conductors. At this time, the proportion A of the number of first conductors and the proportion B1 of the number of first conductors were respectively 100%, and the ratio (B1/A) was 1.00.

Conventional Example 2-1

Conventional Example 2-1 is an example of producing a twisted wire conductor having the same twist structure as that of Example 2-1, except that the twisted wire conductor was constructed only of second conductors formed from a pure copper material (tough pitch copper), without using the first conductor. At this time, the proportion A of the number of first conductors and the proportion B1 of the number of first conductors were respectively 0%.

Conventional Example 2-2

Conventional Example 2-2 is an example of producing a twisted wire conductor having the same twist structure as that of Example 2-1, except that the twisted wire conductor was constructed only of second conductors formed from a pure aluminum material (EC-Al material), without using the first conductor. At this time, the proportion A of the number of first conductors and the proportion B1 of the number of first conductors were respectively 0%.

Conventional Example 2-3

Conventional Example 2-3 is an example of producing a twisted wire conductor having the same twist structure as that of Example 2-21, except that the twisted wire conductor was constructed only of second conductors formed from a pure copper material (tough pitch copper), without using the first conductor. At this time, the proportion A of the number of first conductors and the proportion B1 of the number of first conductors were respectively 0%.

Conventional Example 2-4

Conventional Example 2-4 is an example of producing a twisted wire conductor having the same twist structure as that of Example 2-21, except that the twisted wire conductor was constructed only of second conductors formed from a pure aluminum material (EC-Al material), without using the first conductor. At this time, the proportion A of the number of first conductors and the proportion B1 of the number of first conductors were respectively 0%.

Meanwhile, production conditions A to G for the first conductors as indicated in Table 3 were specifically as follows.

<Production Conditions A>

A prepared rod material was subjected to five sets of a treatment of performing cold working [1] at a working ratio of 1.1 and a stabilization heat treatment [2] for 6 hours at 65° C. in sequence (hereinafter, referred to as treatment set A) (total working ratio of cold working [1]: 5.5). Low temperature annealing [2] was not performed.

<Production Conditions B>

Production was carried out under the same conditions as production conditions A, except that the treatment set A was performed seven times.

<Production Conditions C>

Production was carried out under the same conditions as production conditions A, except that the treatment set A was performed nine times.

<Production Conditions D>

A prepared rod material was subjected to four sets of a treatment of performing cold working [1] at a working ratio of 1.1 and a stabilization heat treatment [2] for 6 hours at 65° C. in sequence (hereinafter, referred to as treatment set A) (total working ratio of cold working [1]: 4.4). Subsequently, low temperature annealing [3] was performed under the conditions of 150° C. and 24 hours.

<Production Conditions E>

Production was carried out under the same conditions as production conditions D, except that the treatment set A was performed five times (total working ratio of cold working [1]: 5.5).

<Production Conditions F>

Production was carried out under the same conditions as production conditions D, except that the treatment set A was performed six times (total working ratio of cold working [1]: 6.6).

<Production Conditions G>

Production was carried out under the same conditions as production conditions D, except that the treatment set A was performed nine times (total working ratio of cold working [1]: 9.9).

Examples 3-1 to 3-24

First, various rod materials having a diameter of 10 mmϕ and having the alloy compositions indicated in Table 5 were prepared, and the initial wire diameters were adjusted using the various rod materials so as to satisfy (the working ratio of) the production conditions and the final element wire diameters described in Table 5. That is, first conductors (specific aluminum alloy wire material) having the wire diameters indicated in Table 5 were produced by adjusting the diameters by die drawing, swaging, rolling, and the like, and then performing annealing. Furthermore, second conductors were produced, according to conventional methods, as various wire materials having the same wire diameters as the first conductors indicated in Table 5 using any metal or alloy selected from the group consisting of copper, copper alloy, aluminum, and aluminum alloy. Then, twisted wire conductors having the twist structure as indicated in Table 5 were produced by twisting together the first conductors of the installation number indicated in Table 5 and the second conductors of the installation number indicated in Table 5. At this time, the proportion A occupied by the number of first conductors in the total number of first conductors and second conductors constituting the twisted wire conductor, the proportion B2 occupied by the number of first conductors in the total number of first conductors and second conductors, which are positioned in a region, and the ratio (B2/A) of the proportion B2 of the number of first conductors to the proportion A of the number of first conductors are respectively presented in Table 5. The alloy composition, metal structure, and production conditions for the first conductors (specific aluminum alloy material), and the type of the material of the second conductors are also presented in Table 5. The remainder of the alloy composition of the first conductors is A1 and unavoidable impurities.

Comparative Examples 3-1 to 3-4

Comparative Examples 3-1 to 3-4 are examples of producing twisted wire conductors having the same twist structure as that of Example 3-1 in the same manner as in Example 3-1, by using first conductor sand second conductors having the alloy compositions as indicated in Table 5 and twisting together the first conductors and the second conductors, except that the proportion B2 of the number of first conductors was lower than the proportion A of the number of first conductors.

Comparative Example 3-5

Comparative Example 3-5 is an example of producing a twisted wire conductor having the same twist structure as that of Example 3-1 by a method similar to Example 3-1, except that the twisted wire conductor was constructed only of first conductors having the alloy composition indicated in Table 5, without using the second conductors. At this time, the proportion A of the number of first conductors and the proportion B2 of the number of first conductors were respectively 100%, and the ratio (B2/A) was 1.00.

Comparative Examples 3-6 to 3-9

Comparative Examples 3-6 to 3-9 are examples of producing twisted wire conductors having the same twist structure as that of Example 3-21 in the same manner as in Example 3-21, by using first conductors and second conductors having the alloy compositions indicated in Table 5 and twisting together the first conductors and the second conductors, except that the proportion B2 of the number of first conductors was lower than the proportion A of the number of first conductors.

Comparative Example 3-10

Comparative Example 3-10 is an example of producing a twisted wire conductor having the same twist structure as that of Example 3-21 by a method similar to Example 3-21, except that the twisted wire conductor was constructed only of first conductors having the alloy composition indicated in Table 5, without using the second conductors. At this time, the proportion A of the number of first conductors and the proportion B2 of the number of first conductors were respectively 100%, and the ratio (B2/A) was 1.00.

Conventional Example 3-1

Conventional Example 3-1 is an example of producing a twisted wire conductor having the same twist structure as that of Example 3-1, except that the twisted wire conductor was constructed only of second conductors formed from a pure copper material (tough pitch copper), without using the first conductors. At this time, the proportion A of the number of first conductors and the proportion B2 of the number of first conductors were respectively 0%.

Conventional Example 3-2

Conventional Example 3-2 is an example of producing a twisted wire conductor having the same twist structure as that of Example 3-1, except that the twisted wire conductor was constructed only of second conductors formed from a pure aluminum material (EC-Al material), without using the first conductors. At this time, the proportion A of the number of first conductors and the proportion B2 of the number of first conductors were respectively 0%.

Conventional Example 3-3

Conventional Example 3-3 is an example of producing a twisted wire conductor having the same twist structure as that of Example 3-21, except that the twisted wire conductor was constructed only of second conductors formed from a pure copper material (tough pitch copper), without using the first conductors. At this time, the proportion A of the number of first conductors and the proportion B2 of the number of first conductors were respectively 0%.

Conventional Example 3-4

Conventional Example 3-4 is an example of producing a twisted wire conductor having the same twist structure as that of Example 3-21, except that the twisted wire conductor was constructed only of second conductors formed from a pure aluminum material (EC-Al material), without using the first conductors. At this time, the proportion A of the number of first conductors and the proportion B2 of the number of first conductors were respectively 0%.

Meanwhile, production conditions A to G for the first conductors as indicated in Table 5 were specifically as follows.

<Production Conditions A>

A prepared rod material was subjected to five sets of a treatment of performing cold working [1] at a working ratio of 1.1 and a stabilization heat treatment [2] for 6 hours at 65° C. in sequence (hereinafter, referred to as treatment set A) (total working ratio of cold working [1]: 5.5). Low temperature annealing [2] was not performed.

<Production Conditions B>

Production was carried out under the same conditions as production conditions A, except that the treatment set A was performed seven times.

<Production Conditions C>

Production was carried out under the same conditions as production conditions A, except that the treatment set A was performed nine times.

<Production Conditions D>

A prepared rod material was subjected to four sets of a treatment of performing cold working [1] at a working ratio of 1.1 and a stabilization heat treatment [2] for 6 hours at 65° C. in sequence (hereinafter, referred to as treatment set A) (total working ratio of cold working [1]: 4.4). Subsequently, low temperature annealing [3] was performed under the conditions of 150° C. and 24 hours.

<Production conditions E>

Production was carried out under the same conditions as production conditions D, except that the treatment set A was performed five times (total working ratio of cold working [1]: 5.5).

<Production Conditions F>

Production was carried out under the same conditions as production conditions D, except that the treatment set A was performed six times (total working ratio of cold working [1]: 6.6).

<Production Conditions G>

Production was carried out under the same conditions as production conditions D, except that the treatment set A was performed nine times (total working ratio of cold working [1]: 9.9).

[Evaluation]

Evaluation of characteristics as described below was carried out using the respective twisted wire conductors thus produced. The evaluation conditions for the respective characteristics were as follows. The results are presented in Table 2, Table 4, and Table 6.

[1] Alloy Composition of First Conductor (Specific Aluminum Alloy Material)

The alloy composition of the first conductors (specific aluminum alloy material) was measured by an emission spectral analysis according to JIS H1305:2005. Meanwhile, the measurement was carried out using an emission spectral analyzer (manufactured by Hitachi High-Tech Science Corporation).

[2] Observation of Structure of First Conductor (Specific Aluminum Alloy Material)

Observation of the metal structure was carried out by scanning transmission electron microscopy (STEM) observation using a transmission electron microscope, JEM-3100FEF (manufactured by JEOL, Ltd.).

Regarding a sample for observation, a sample obtained by cutting the above-described wire material at a cross-section parallel to the longitudinal direction (direction of wire drawing X) of the wire material to a thickness of 100 nm±20 nm by means of focused ion beam (FIB) and finishing the resultant by ion milling, was used.

In the STEM observation, grey contrast was used, the difference in the contrast was considered as the orientation of crystals, and thereby, boundaries at which the contrast was discontinuously different were recognized as crystal grain boundaries. Meanwhile, there are occasions in which, depending on the diffraction conditions for the electron beam, there is no difference in the grey contrast even if there is a difference in the crystal orientation. In that case, the grain boundaries were recognized by changing the angle between the electron beam and the sample by inclining at ±3° each time by means of two axes of sample rotation orthogonally intersecting each other in a sample stage of the electron microscope, an image of the observation surface was captured under a plurality of diffraction conditions, and grain boundaries were recognized. Furthermore, the visual field for observation was set to (15 to 40) μm×(15 to 40) μm, and observation was performed at a position in the vicinity between the center and the surface area (a position on the central side only by about ¼ of the wire diameter from the surface layer side) on a line corresponding to the wire diameter direction (direction perpendicular to the longitudinal direction) in the above-mentioned cross-section. The visual field for observation was appropriately adjusted according to the size of the crystal grains.

Figure 11:
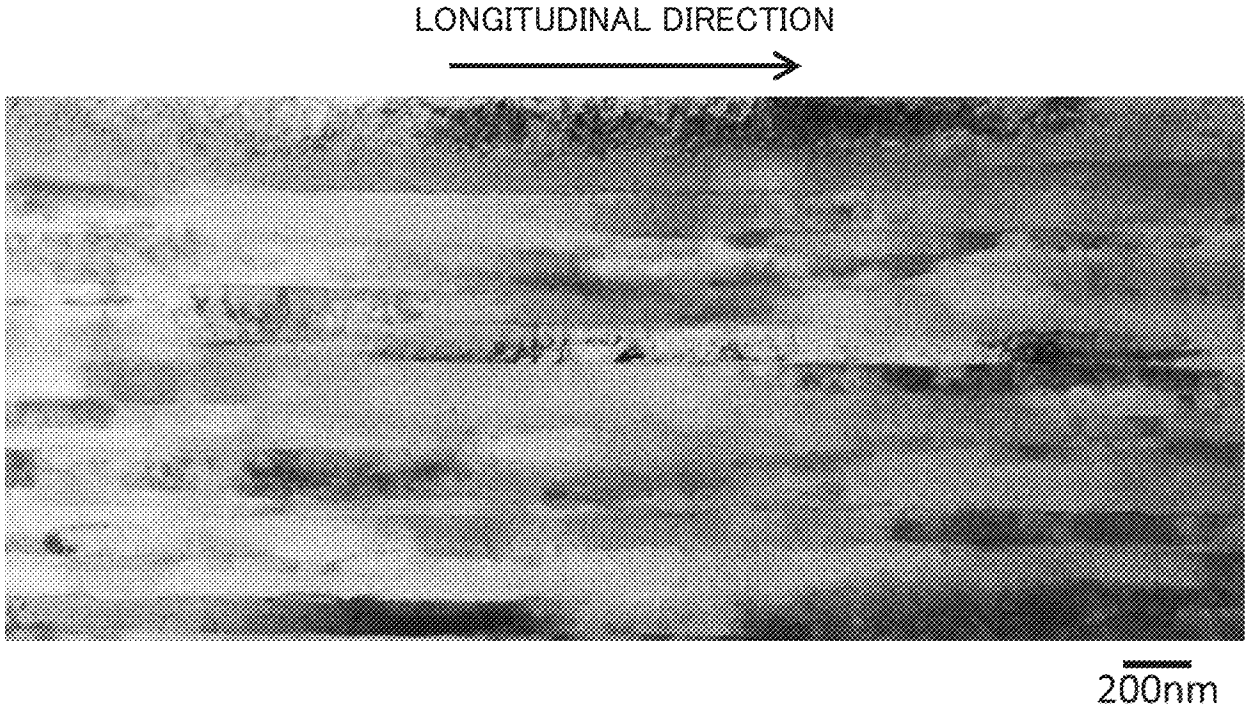
FIG. 11 is a STEM image obtained when the metal structure of the specific aluminum alloy material of the first conductor of Example 1 is observed at a cross-section parallel to the direction of wire drawing X.

Then, from an image captured at the time of performing the STEM observation, the presence or absence of a fibrous metal structure in a cross-section parallel to the longitudinal direction (direction of wire drawing X) of the wire material was determined. FIG. 11 is a portion of a STEM image of a cross-section parallel to the longitudinal direction (direction of wire drawing X) of a first conductor of the twisted wire conductor of Example 1-1, which was captured at the time of performing the STEM observation. In the present Example, in a case in which the metal structure shown in FIG. 11 was observed in the first conductor, it was evaluated as a fibrous metal structure, and in the columns of Table 1, Table 3, and Table 5, it was described as "Present".

Furthermore, in each visual field of observation, any arbitrary one hundred crystal grains were selected, the dimension perpendicular to the longitudinal direction of each crystal grain and the dimension parallel to the longitudinal direction of the crystal grain were measured, and the aspect ratio of the crystal grain was calculated. Furthermore, for the dimension perpendicular to the longitudinal direction of a crystal grain and the aspect ratio, the average values were calculated from the total number of observed crystal grains. Meanwhile, in a case in which the observed crystal grains were obviously larger than 400 nm, the crystal grains were not selected as the crystal grains for measuring the respective dimensions and were excluded from the object of measurement, and the respective average values were calculated. Furthermore, for a crystal grain in which the dimension parallel to the longitudinal direction of the crystal grain was obviously larger than ten times the dimension perpendicular to the longitudinal direction of the crystal grain, it was uniformly evaluated that the aspect ratio was greater than 10, and in Table 1, Table 3, and Table 5, it was described as ">10".

[3] Bending Fatigue Resistance

The bending fatigue resistance was evaluated in a state in which the twisted wire conductor was provided with an insulating coating. Twisted wire conductors having a structure of 30 (number of conductors)/0.18 (element wire diameter) and twisted wire conductors having a structure of 88 (number of conductors)/0.30 (element wire diameter) were all subjected to a reversed bending fatigue test according to JIS Z 2273 (1978). The test conditions were such that the bend radius was 5 mm, and the number of repetitions was set to 1,000,000 times. Furthermore, twisted wire conductors having a structure of 7/34 (total number of conductors (238 pieces))/0.45 (element wire diameter) were subjected to a repeated bending test according to JIS C 3005:2014. The test conditions were such that the fixed distance 1 was set to 300 mm, the bend radius r was set to 100 mm, and the number of repetitions was set to 1,000,000 times. After the test, the number of conductors (element wires) that had the insulating coating torn off and were broken was counted. In Table 2 and Table 6, regarding the bending fatigue resistance, the percentage of the number of conductors that were broken on the basis (100%) of the number of broken wires in a test with a twisted wire conductor using EC-AL was calculated. For example, in a case in which ten conductors were broken in a test with a twisted wire conductor made of EC-AL, while only three conductors were broken in a test with the twisted wire conductor according to the present invention, the percentage was 30%, and as this number is smaller, it is implied that the bending fatigue resistance is superior. In Table 4, a case in which the number of conductors that were broken among all of the conductors was 5% or less is described as "A"; a case in which the number was more than 5% and less than or equal to 10% is described as "B"; a case in which the number was more than 10% and less than or equal to 15% is described as "C"; a case in which the number was more than 15% and less than or equal to 20% is described as "D"; and a case in which the number was more than 20% and less than or equal to 30% is described as "E". A and B were considered as acceptable levels.

[4] Electrical Conductivity

The electrical conductivity was measured with electrical wires having a length of 1 m and provided with an insulating coating, by a Wheatstone Bridge method according to JIS C 3005 (2014). Then, the result was converted to a value per kilometer of the wire length. Measurement was made at 20° C. Meanwhile, in the present Example, regarding the electrical conductivity (conductor resistance), in the case of a twisted wire conductor having a twist structure of 30/0.18, a value of 50 Ω/km or less, which was below the values of the Conventional Examples, was considered as an acceptable level; in the case of a twisted wire conductor having a twist structure of 7/34/0.45, a value of 1.0 Ω/km or less, which was below the values of the Conventional Examples, was considered as an acceptable level; and in the case of a twisted wire conductor having a twist structure of 88/0.30, a value of 5.8 Ω/km or less, which was below the values of the Comparative Examples, was considered as an acceptable level. The evaluation results for the electrical conductivity (conductor resistance) are presented in Table 2, Table 4, and Table 6.

[5] Weight of Twisted Wire Conductor

Regarding the weight of a twisted wire conductor, the weight was measured in a state of the twisted wire conductor before being provided with an insulating coating. The weight was measured for a length of 1 m and was converted to a value per kilometer of the wire length. Meanwhile, in the present Example, regarding the weight of the twisted wire conductor, in the case of a twisted wire conductor having a twist structure of 30/0.18, a value of 6.5 kg/km or less, which was below the values of the Conventional Examples, was considered as an acceptable level; in the case of a twisted wire conductor having a twist structure of 7/34/0.45, a value of 330 kg/km or less, which was below the values of the Conventional Examples, was considered as an acceptable level; and in the case of a twisted wire conductor having a twist structure of 88/0.30, a value of 54.0 kg/km or less, which was below the values of Conventional Examples, was considered as an acceptable level. The measurement results for the weight of the twisted wire conductors are presented in Table 2, Table 4, and Table 6.

[6] Non-Easiness in Deformation

A twisted wire conductor that had been cut into a length of 1 m was straightened (state in which the bending angle was) 0° and was bent at the center in the longitudinal direction of the twisted wire conductor along circular jig having a diameter that was five times the diameter of the twisted wire conductor, until the bending angle reached 90°. Then, after springing back concomitantly with unloading, the twisted wire conductor did not return to the initial state of 0°, and in a case in which permanent distortion remained, the angle was measured. As this angle is smaller, the non-easiness in deformation is satisfactory. A case in which the angle was more than 6° and less than 10° is described as an acceptable level (C); a case in which the angle was 3° or more and less than 6° is described as a more preferable level (B); and a case in which the angle was 0° or more and less than 3° is described as an even more preferable level (A). A case in which the angle was 10° or more is described as an unacceptable level (D). The non-easiness in deformation (difficulty in deformation) of the twisted wire conductors is presented in Table 4.

[7] Easiness in Deformation

A twisted wire conductor was subjected to 90° bending according to JIS C 3005:2014, and by measuring the force required at that time, the easiness in deformation of the twisted wire conductor was evaluated. It was determined how many times of force is required with respect to the force for a twisted wire conductor constructed of standard TPC (O). The case of a force more than or equal to 1.2 times and less than 1.3 time is described as an unacceptable level (C); the case of a force more than or equal to 1.1 times and less than 1.2 times is described as a more preferable level (B); and the case of a force more than or equal to 1.0 time and less than 1.1 times is described as an even more preferable level (A). A case in which a force of 1.3 times or more is required is described as an unacceptable level (D). The easiness in deformation (ease of deformation) of the twisted wire conductors is presented in Table 6.

TABLE 1-1

| | Twisted wire conductor 10 | | | | | | | |
|---|---|---|---|---|---|---|---|---|
| | First conductor 20 | | | | | | | |
| | | Alloy composition (mass %) | | | | | | |
| | | | | | Other alloy component | | | |
| | Installation number (pieces) | Mg | Si | Fe | Component 1 | Component 2 | Component 3 | Total content |
| Example1-1 | 29 | 0.54 | 0.52 | 0.19 | — | — | — | <0.05 |
| Example1-2 | 15 | 0.54 | 0.52 | 0.19 | — | — | — | <0.05 |
| Example1-3 | 1 | 0.54 | 0.52 | 0.19 | — | — | — | <0.05 |
| Example1-4 | 15 | 0.54 | 0.52 | 0.19 | — | — | — | <0.05 |
| Example1-5 | 15 | 0.54 | 0.52 | 0.19 | — | — | — | <0.05 |
| Example1-6 | 15 | 0.54 | 0.52 | 0.19 | — | — | — | <0.05 |
| Example1-7 | 15 | 0.54 | 0.52 | 0.19 | — | — | — | <0.05 |
| Example1-8 | 15 | 0.54 | 0.52 | 0.19 | — | — | — | <0.05 |
| Example1-9 | 15 | 0.54 | 0.52 | 0.19 | — | — | — | <0.05 |
| Example1-10 | 15 | 0.54 | 0.52 | 0.02 | — | — | — | <0.05 |
| Example1-11 | 15 | 0.54 | 0.52 | 0.31 | — | — | — | <0.05 |
| Example1-12 | 15 | 0.54 | 0.52 | 0.19 | 0.08 Zr | 0.08 Mn | — | 0.16 |
| Example1-13 | 15 | 0.54 | 0.52 | 0.19 | 0.12 Ni | 0.08 Sn | 0.07 Au | 0.27 |
| Example1-14 | 15 | 0.54 | 0.52 | 0.19 | 0.06 Ti | 0.07 V | 0.07 Co | 0.20 |
| Example1-15 | 29 | 0.54 | 0.52 | 0.19 | — | — | — | <0.05 |
| Example1-16 | 22 | 0.54 | 0.52 | 0.19 | — | — | — | <0.05 |
| Example1-17 | 15 | 0.54 | 0.52 | 0.19 | — | — | — | <0.05 |
| Example1-18 | 8 | 0.54 | 0.52 | 0.19 | — | — | — | <0.05 |
| Example1-19 | 1 | 0.54 | 0.52 | 0.19 | — | — | — | <0.05 |
| Example1-20 | 15 | 0.22 | 0.22 | 0.19 | — | — | — | <0.05 |
| Example1-21 | 15 | 1.75 | 1.94 | 0.19 | — | — | — | <0.05 |
| Example1-22 | 15 | 0.95 | 0.58 | 0.28 | 1.44 Cu | 0.45 Cr | — | 1.89 |
| Example1-23 | 15 | 0.54 | 0.52 | 0.19 | 0.15 Ag | 0.11 Zn | — | 0.26 |

| | Twisted wire conductor 10 | | | | | | | |
|---|---|---|---|---|---|---|---|---|
| | First conductor 20 | | | | | | | |
| | Metal structure | | | | | | | Proportion |
| | Presence or absence of fibrous metal structure | Dimension t perpendicular to longitudinal direction of crystal grain | Aspect ratio of crystal grain | Production conditions | Second conductor 40 Installation number (pieces) | Second conductor 40 Type of material | Twist structure | occupied by total crossectional area S1 of first conductors (S1/S) × 100(%) |
| Example1-1 | Present | 130 nm | ≥10 | C | 1 | TPC(O) | 30/0.18 | 97 |
| Example1-2 | Present | 130 nm | ≥10 | C | 15 | TPC(O) | 30/0.18 | 50 |
| Example1-3 | Present | 130 nm | ≥10 | C | 29 | TPC(O) | 30/0.18 | 3 |
| Example1-4 | Present | 320 nm | ≥10 | A | 15 | TPC(O) | 30/0.18 | 50 |
| Example1-5 | Present | 80 nm | ≥10 | D | 15 | TPC(O) | 30/0.18 | 50 |
| Example1-6 | Present | 340 nm | ≥10 | E | 15 | TPC(O) | 30/0.18 | 50 |
| Example1-7 | Present | 240 nm | ≥10 | F | 15 | TPC(O) | 30/0.18 | 50 |
| Example1-8 | Present | 150 nm | ≥10 | G | 15 | TPC(O) | 30/0.18 | 50 |
| Example1-9 | Present | 100 nm | ≥10 | H | 15 | TPC(O) | 30/0.18 | 50 |
| Example1-10 | Present | 140 nm | ≥10 | C | 15 | TPC(O) | 30/0.18 | 50 |
| Example1-11 | Present | 110 nm | ≥10 | C | 15 | TPC(O) | 30/0.18 | 50 |
| Example1-12 | Present | 80 nm | ≥10 | C | 15 | TPC(O) | 30/0.18 | 50 |
| Example1-13 | Present | 80 nm | ≥10 | C | 15 | TPC(O) | 30/0.18 | 50 |
| Example1-14 | Present | 80 nm | ≥10 | C | 15 | TPC(O) | 30/0.18 | 50 |

TABLE 1-1-continued

| | | | | | | | | |
|---|---|---|---|---|---|---|---|---|
| Example1-15 | Present | 130 nm | ≥10 | C | 1 | EC-AL(H) | 30/0.18 | 97 |
| Example1-16 | Present | 130 nm | ≥10 | C | 8 | EC-AL(H) | 30/0.18 | 70 |
| Example1-17 | Present | 130 nm | ≥10 | C | 15 | EC-AL(H) | 30/0.18 | 50 |
| Example1-18 | Present | 130 nm | ≥10 | C | 22 | EC-AL(H) | 30/0.18 | 27 |
| Example1-19 | Present | 130 nm | ≥10 | C | 29 | EC-AL(H) | 30/0.18 | 3 |
| Example1-20 | Present | 160 nm | ≥10 | C | 15 | EC-AL(H) | 30/0.18 | 50 |
| Example1-21 | Present | 80 nm | ≥10 | C | 15 | EC-AL(H) | 30/0.18 | 50 |
| Example1-22 | Present | 90 nm | ≥10 | C | 15 | EC-AL(H) | 30/0.18 | 50 |
| Example1-23 | Present | 100 nm | ≥10 | C | 15 | EC-AL(H) | 30/0.18 | 50 |

TABLE 1-2

| | Twisted wire conductor 10 | | | | | | | |
|---|---|---|---|---|---|---|---|---|
| | First conductor 20 | | | | | | | |
| | | Alloy composition (mass %) | | | | | | |
| | | | | | Other alloy component | | | |
| | Installation number (pieces) | Mg | Si | Fe | Component 1 | Component 2 | Component 3 | Total content |
| Example1-24 | 15 | 0.54 | 0.52 | 0.19 | — | — | — | <0.05 |
| Comparative Example1-1 | 30 | 0.85 | 0.85 | 0.19 | — | — | — | <0.05 |
| Comparative Example1-2 | 15 | 0.16 | 0.16 | 0.19 | — | — | — | <0.05 |
| Comparative Example1-3 | — | 1.85 | 2.08 | 0.19 | — | — | — | <0.05 |
| Comparative Example1-4 | 15 | 0.54 | 0.52 | 0.00 | — | — | — | <0.05 |
| Comparative Example1-5 | — | 0.54 | 0.52 | 0.38 | — | — | — | <0.05 |
| Comparative Example1-6 | — | 0.85 | 0.85 | 0.19 | 1.51 Cu | 0.62 Cr | — | 2.13 |
| Comparative Example1-7 | 15 | 0.54 | 0.52 | 0.19 | — | — | — | <0.05 |
| Comparative Example1-8 | — | 0.54 | 0.52 | 0.19 | — | — | — | <0.05 |
| Conventional Example1-1 | 0 | — | — | — | — | — | — | — |
| Conventional Example1-2 | 0 | — | — | — | — | — | — | — |
| Example1-25 | | 0.54 | 0.52 | 0.19 | — | — | — | <0.05 |
| Example1-26 | 231 | 0.54 | 0.52 | 0.19 | — | — | — | <0.05 |
| Example1-27 | 119 | 0.54 | 0.52 | 0.19 | — | — | — | <0.05 |
| Example1-28 | 7 | 0.54 | 0.52 | 0.19 | — | — | — | <0.05 |
| Example1-29 | 231 | 0.54 | 0.52 | 0.19 | — | — | — | <0.05 |
| Example1-30 | 119 | 0.54 | 0.52 | 0.19 | — | — | — | <0.05 |
| Comparative Example1-9 | 7 | 0.54 | 0.52 | 0.19 | — | — | — | <0.05 |
| Conventional Example1-3 | 238 | 0.85 | 0.85 | 0.19 | — | — | — | <0.05 |
| Conventional Example1-4 | 0 | — | — | — | — | — | — | — |

| | Twisted wire conductor 10 | | | | | | | |
|---|---|---|---|---|---|---|---|---|
| | First conductor 20 | | | | | | | |
| | Metal structure | | | | | | | Proportion |
| | Presence or absence of fibrous metal structure | Dimension t perpendicular to longitudinal direction of crystal grain | Aspect ratio of crystal grain | Production conditions | Second conductor 40 | | Twist structure | occupied by total crossectional area S1 of first conductors (S1/S) × 100(%) |
| | | | | | Installation number (pieces) | Type of material | | |
| Example1-24 | Present | 130 nm | ≥10 | C | 87 | TPC(O) EO-AL(H) | 30/0.18 | 50 |
| Comparative Example1-1 | Present | 130 nm | ≥10 | C | 0 | — | 30/0.18 | 100 |
| Comparative Example1-2 | Present | | ≥10 | C | 15 | EO-AL(H) | 30/0.18 | 50 |

TABLE 1-2-continued

| | | | | | | | | |
|---|---|---|---|---|---|---|---|---|
| Comparative Example1-3 | — | — | — | K | — | — | — | — |
| Comparative Example1-4 | Present | 430 nm | ≥10 | A | 15 | EO-AL(H) | 30/0.18 | 50 |
| Comparative Example1-5 | — | — | — | K | — | — | — | — |
| Comparative Example1-6 | — | — | — | K | — | — | — | — |
| Comparative Example1-7 | Present | 450 nm | ≥10 | T | 15 | EO-AL(H) | 30/0.18 | 55 |
| Comparative Example1-8 | — | — | — | J | — | — | — | — |
| Conventional Example1-1 | — | — | — | — | 30 | TPC(O) | 30/0.18 | 0 |
| Conventional Example1-2 | — | — | — | — | 30 | EO-AL(H) | 30/0.18 | 0 |
| Example1-25 | Present | 220 nm | ≥10 | B | 7 | TPC(O) | 7/34/0.45 | 97 |
| Example1-26 | Present | 220 nm | ≥10 | B | 119 | TPC(O) | 7/34/0.45 | 50 |
| Example1-27 | Present | 220 nm | ≥10 | B | 231 | TPC(O) | 7/34/0.45 | 3 |
| Example1-28 | Present | 220 nm | ≥10 | B | 7 | EO-AL(H) | 7/34/0.45 | 9 |
| Example1-29 | Present | 220 nm | ≥10 | B | 119 | EO-AL(H) | 7/34/0.45 | 50 |
| Example1-30 | Present | 220 nm | ≥10 | B | 231 | EO-AL(H) | 7/34/0.45 | 3 |
| Comparative Example1-9 | Present | 220 nm | ≥10 | B | 0 | — | 7/34/0.45 | 100 |
| Conventional Example1-3 | — | — | — | — | 238 | TPC(O) | 7/34/0.45 | 0 |
| Conventional Example1-4 | — | — | — | — | 238 | EO-AL(H) | 7/34/0.45 | 0 |

TABLE 2

| | Evaluation of performance of twisted wire conductor and coated wire | | |
|---|---|---|---|
| | Bending fatigue resistance (%) | Conductor resistance (Ω/km) | Weight of twisted wire conductor (kg/km) |
| Example1-1 | 0 | 46.77 | 2.219 |
| Example1-2 | 0 | 32.22 | 4.428 |
| Example1-3 | 0 | 25.00 | 6.479 |
| Example1-4 | 0 | 32.22 | 4.423 |
| Example1-5 | 0 | 32.22 | 4.428 |
| Example1-6 | 0 | 32.22 | 4.428 |
| Example1-7 | 0 | 32.22 | 4.428 |
| Example1-8 | 0 | 32.22 | 4.428 |
| Example1-9 | 0 | 32.22 | 4.428 |
| Example1-10 | 0 | 32.01 | 4.428 |
| Example1-11 | 0 | 32.22 | 4.428 |
| Example1-12 | 0 | 32.88 | 4.428 |
| Example1-13 | 0 | 33.10 | 4.428 |
| Example1-14 | 0 | 32.44 | 4.428 |
| Example1-15 | 0 | 47.98 | 2.061 |
| Example1-16 | 0 | 45.65 | 2.061 |
| Example1-17 | 0 | 43.54 | 2.061 |
| Example1-18 | 0 | 41.62 | 2.061 |
| Example1-19 | 10 | 39.85 | 2.061 |
| Example1-20 | 0 | 41.31 | 2.061 |
| Example1-21 | 0 | 44.34 | 2.061 |
| Example1-22 | 0 | 46.47 | 2.061 |
| Example1-23 | 0 | 45.59 | 2.061 |
| Example1-24 | 0 | 36.67 | 3.323 |
| Comparative Example1-1 | 0 | 52.53 | 2.061 |
| Comparative Example1-2 | 100 | 40.96 | 2.061 |
| Comparative Example1-3 | — | — | — |
| Comparative Example1-4 | 100 | 43.54 | 2.061 |
| Comparative Example1-5 | — | — | — |
| Comparative Example1-6 | — | — | — |

TABLE 2-continued

| | Evaluation of performance of twisted wire conductor and coated wire | | |
|---|---|---|---|
| | Bending fatigue resistance (%) | Conductor resistance (Ω/km) | Weight of twisted wire conductor (kg/km) |
| Comparative Example1-7 | 100 | 43.54 | 2.061 |
| Comparative Example1-8 | — | — | — |
| Conventional Example1-1 | 0 | 24.17 | 6.794 |
| Conventional Example1-2 | 100 | 39.62 | 2.061 |
| Example1-25 | 0 | 2.9469 | 109.1 |
| Example1-26 | 0 | 0.6498 | 219.5 |
| Example1-27 | 0 | 0.5021 | 323.1 |
| Example1-28 | 0 | 0.9685 | 102.2 |
| Example1-29 | 10 | 0.8781 | 102.2 |
| Example1-30 | 30 | 0.8032 | 102.2 |
| Comparative Example-1-9 | 0 | 1.0595 | 102.2 |
| Conventional Example1-3 | 0 | 0.4874 | 336.9 |
| Conventional Example1-4 | 100 | 0.7990 | 102.2 |

TABLE 3-1

| Twisted wire conductor 10 | | | | | | | | |
|---|---|---|---|---|---|---|---|---|
| | First conductor 20 | | | | | | | |
| | | Alloy composition (mass %) | | | | | | |
| | | | | | Other alloy component | | | |
| | Installation number (pieces) | Mg | Si | Fe | Component 1 | Component 2 | Component 3 | Total content |
| Example2-1 | 5 | 0.54 | 0.52 | 0.19 | — | — | — | <0.05 |
| Example2-2 | 10 | 0.54 | 0.52 | 0.19 | — | — | — | <0.05 |
| Example2-3 | 20 | 0.54 | 0.52 | 0.19 | — | — | — | <0.05 |
| Example2-4 | 25 | 0.54 | 0.52 | 0.19 | — | — | — | <0.05 |
| Comparative Example2-1 | 5 | 0.54 | 0.52 | 0.19 | — | — | — | <0.05 |
| Comparative Example2-2 | 10 | 0.54 | 0.52 | 0.19 | — | — | — | <0.05 |
| Comparative Example2-3 | 20 | 0.54 | 0.52 | 0.19 | — | — | — | <0.05 |
| Comparative Example2-4 | 25 | 0.54 | 0.52 | 0.19 | — | — | — | <0.05 |
| Conventional Example2-1 | 0 | — | — | — | — | — | — | — |
| Conventional Example2-2 | 0 | — | — | — | — | — | — | — |
| Comparative Example2-5 | 30 | 0.54 | 0.52 | 0.19 | — | — | — | <0.05 |
| Example2-2 | 30 | 0.54 | 0.52 | 0.19 | — | — | — | <0.05 |
| Example2-6 | 15 | 0.54 | 0.52 | 0.19 | — | — | — | <0.05 |
| Example2-7 | 15 | 0.54 | 0.52 | 0.19 | — | — | — | <0.05 |
| Example2-8 | 15 | 0.54 | 0.52 | 0.19 | — | — | — | <0.05 |
| Example2-9 | 15 | 0.54 | 0.52 | 0.19 | — | — | — | <0.05 |
| Example2-10 | 15 | 0.54 | 0.52 | 0.19 | — | — | — | <0.05 |
| Example2-11 | 15 | 0.54 | 0.52 | 0.19 | — | — | — | <0.05 |
| Example2-12 | 15 | 0.54 | 0.52 | 0.31 | — | — | — | <0.05 |

| Twisted wire conductor 10 | | | | | | | | | | |
|---|---|---|---|---|---|---|---|---|---|---|
| | First conductor 20 | | | | | | | | | |
| | Metal structure | | | | | | | | | |
| | Presence or absence of fibrous metal structure | Dimension t perpendicular to longitudinal direction of crystal grain | Aspect ratio of crystal grain | Production conditions | Second conductor 40 | | Twist structure | Proportion of the number of first conductors A (%) | Proportion of the number of first conductors B1 (%) | B1/A |
| | | | | | Installation number (pieces) | Type of material | | | | |
| Example2-1 | Present | 130 nm | >10 | B | 25 | TPC(O) | 30/0.18 | 16.7 | 26.3 | 1.57 |
| Example2-2 | Present | 130 nm | >10 | B | 20 | TPC(O) | 30/0.18 | 33.3 | 52.6 | 1.58 |
| Example2-3 | Present | 130 nm | >10 | B | 10 | TPC(O) | 30/0.18 | 66.6 | 100.0 | 1.50 |
| Example2-4 | Present | 130 nm | >10 | B | 5 | TPC(O) | 30/0.18 | 83.3 | 100.0 | 1.20 |
| Comparative Example2-1 | Present | 130 nm | >10 | B | 25 | TPC(O) | 30/0.18 | 16.7 | 15.8 | 0.95 |
| Comparative Example2-2 | Present | 130 nm | >10 | B | 20 | TPC(O) | 30/0.18 | 33.3 | 31.6 | 0.95 |
| Comparative Example2-3 | Present | 130 nm | >10 | B | 10 | TPC(O) | 30/0.18 | 66.6 | 63.2 | 0.95 |
| Comparative Example2-4 | Present | 130 nm | >10 | B | 5 | TPC(O) | 30/0.18 | 83.3 | 78.9 | 0.95 |
| Conventional Example2-1 | — | — | — | — | 30 | TPC(O) | 30/0.18 | 0 | 0 | — |
| Conventional Example2-2 | — | — | — | — | 30 | EC-AL(H) | 30/0.18 | 0 | 0 | — |
| Comparative Example2-5 | Present | 130 nm | >10 | B | 0 | — | 30/0.18 | 100.0 | 100.0 | 1.00 |
| Example2-2 | Present | 320 nm | >10 | A | 10 | TPC(O) | 30/0.18 | 66.6 | 100.0 | 1.54 |
| Example2-6 | Present | 90 nm | >10 | C | 15 | TPC(O) | 30/0.18 | 66.6 | 100.0 | 1.54 |
| Example2-7 | Present | 240 nm | >10 | D | 15 | TPC(O) | 30/0.18 | 66.6 | 100.0 | 1.54 |
| Example2-8 | Present | 240 nm | >10 | E | 15 | TPC(O) | 30/0.18 | 66.6 | 100.0 | 1.54 |
| Example2-9 | Present | 150 nm | >10 | F | 15 | TPC(O) | 30/0.18 | 66.6 | 100.0 | 1.54 |
| Example2-10 | Present | 100 nm | >10 | G | 15 | TPC(O) | 30/0.18 | 66.6 | 100.0 | 1.54 |
| Example2-11 | Present | 140 nm | >10 | B | 15 | TPC(O) | 30/0.18 | 66.6 | 100.0 | 1.54 |
| Example2-12 | Present | 110 nm | >10 | B | 15 | TPC(O) | 30/0.18 | 66.6 | 100.0 | 1.54 |

TABLE 3-2

| Twisted wire conductor 10 | | | | | | | | |
|---|---|---|---|---|---|---|---|---|
| | First conductor 20 | | | | | | | |
| | | Alloy composition (mass %) | | | | | | |
| | | | | | Other alloy component | | | |
| | Installation number (pieces) | Mg | Si | Fe | Component 1 | Component 2 | Component 3 | Total content |
| Example2-13 | 15 | 0.54 | 0.52 | 0.19 | 0.08 Zr | 0.08 Mn | — | 0.16 |
| Example2-14 | 15 | 0.54 | 0.52 | 0.19 | 0.12 Ni | 0.08 Sn | 0.07 Au | 0.27 |
| Example2-15 | 15 | 0.54 | 0.52 | 0.19 | 0.06 Ti | 0.07 V | 0.07 Co | 0.20 |
| Example2-16 | 15 | 0.22 | 0.22 | 0.19 | — | — | — | <0.05 |
| Example2-17 | 15 | 1.75 | 1.94 | 0.19 | — | — | — | <0.05 |
| Example2-18 | 15 | 0.95 | 0.56 | 0.28 | 1.44 Cu | 0.45 Cr | — | |
| Example2-19 | 15 | 0.54 | 0.52 | 0.19 | 0.15 Ag | 0.11 Zn | — | |
| Example2-20 | 15 | 0.54 | 0.52 | 0.19 | — | — | — | <0.05 |
| Example2-21 | 15 | 0.54 | 0.52 | 0.19 | — | — | — | <0.05 |
| Example2-22 | 29 | 0.54 | 0.52 | 0.19 | — | — | — | <0.05 |
| Example2-23 | 59 | 0.54 | 0.52 | 0.19 | — | — | — | <0.05 |
| Example2-24 | 73 | 0.54 | 0.52 | 0.19 | — | — | — | <0.05 |
| Comparative Example2-6 | 15 | 0.54 | 0.52 | 0.19 | — | — | — | <0.05 |
| Comparative Example2-7 | 29 | 0.54 | 0.52 | 0.19 | — | — | — | <0.05 |
| Comparative Example2-8 | 59 | 0.54 | 0.52 | 0.19 | — | — | — | <0.05 |
| Comparative Example2-9 | 73 | 0.54 | 0.52 | 0.19 | — | — | — | <0.05 |
| Conventional Example2-3 | 0 | — | 0.52 | 0.19 | — | — | — | — |
| Comparative Example2-4 | 0 | — | 0.52 | 0.19 | — | — | — | — |
| Comparative Example2-10 | 88 | 0.54 | 0.52 | 0.19 | — | — | — | <0.05 |

| Twisted wire conductor 10 | | | | | | | | | | |
|---|---|---|---|---|---|---|---|---|---|---|
| | First conductor 20 | | | | | | | | | |
| | Metal structure | | | | | | | | | |
| | Presence or absence of fibrous metal structure | Dimension t perpendicular to longitudinal direction of crystal grain | Aspect ratio of crystal grain | Production conditions | Second conductor 40 | | Twist structure | Proportion of the number of first conductors A (%) | Proportion of the number of first conductors B2 (%) | B2/A |
| | | | | | Installation number (pieces) | Type of material | | | | |
| Example2-13 | Present | 80 nm | >10 | B | 15 | TPC(O) | 30/0.18 | 66.6 | 100.0 | 1.54 |
| Example2-14 | Present | 80 nm | >10 | B | 15 | TPC(O) | 30/0.18 | 66.6 | 100.0 | 1.54 |
| Example2-15 | Present | 80 nm | >10 | B | 15 | TPC(O) | 30/0.18 | 66.6 | 100.0 | 1.54 |
| Example2-16 | Present | 160 nm | >10 | B | 15 | EC-AL(H) | 30/0.18 | 66.6 | 100.0 | 1.54 |
| Example2-17 | Present | 80 nm | >10 | B | 15 | EC-AL(H) | 30/0.18 | 66.6 | 100.0 | 1.54 |
| Example2-18 | Present | 90 nm | >10 | B | 15 | EC-AL(H) | 30/0.18 | 66.6 | 100.0 | 1.54 |
| Example2-19 | Present | 100 nm | >10 | B | 15 | EC-AL(H) | 30/0.18 | 66.6 | 100.0 | 1.54 |
| Example2-20 | Present | 130 nm | >10 | B | 15 | EC-AL(H) | 30/0.18 | 66.6 | 100.0 | 1.50 |
| Example2-21 | Present | 130 nm | >10 | B | 73 | TPC(O) | 88/0.30 | 17.0 | 45.5 | 2.68 |
| Example2-22 | Present | 130 nm | >10 | B | 59 | TPC(O) | 88/0.30 | 33.0 | 100.0 | 3.03 |
| Example2-23 | Present | 130 nm | >10 | B | 29 | TPC(O) | 88/0.30 | 67.0 | 100.0 | 1.49 |
| Example2-24 | Present | 130 nm | >10 | B | 15 | TPC(O) | 88/0.30 | 83.0 | 100.0 | 1.20 |
| Comparative Example2-6 | Present | 130 nm | >10 | B | 73 | TPC(O) | 88/0.30 | 17.0 | 15.2 | 0.89 |
| Comparative Example2-7 | Present | 130 nm | >10 | B | 59 | TPC(O) | 80/0.30 | 33.0 | 30.3 | 0.92 |
| Comparative Example2-8 | Present | 130 nm | >10 | B | 29 | TPC(O) | 80/0.30 | 67.0 | 63.6 | 0.95 |
| Comparative Example2-9 | Present | 130 nm | >10 | B | 15 | TPC(O) | 80/0.30 | 83.0 | 75.3 | 0.91 |
| Conventional Example2-3 | — | — | — | — | 86 | TPC(O) | 68/0.30 | 0 | 0 | — |
| Comparative Example2-4 | — | — | — | — | 86 | TPC(O) | 68/0.30 | 0 | 0 | — |
| Comparative Example2-10 | Present | 130 nm | >10 | B | 0 | EC-AL(H) | 68/0.30 | 100.0 | 100.0 | 1.00 |

TABLE 4

| | Evaluation of characteristics | | | |
|---|---|---|---|---|
| | Bending fatigue resistance | Conductor resistance (Ω/km) | Weight of twisted wire conductor (kg/km) | Non-easines in deformation |
| Example2-1 | A | 26.4 | 6.01 | B |
| Example2-2 | A | 29.0 | 5.22 | E |
| Example2-3 | A | 36.2 | 3.64 | E |
| Example2-4 | B | 41.4 | 2.85 | C |
| Comparative Example2-1 | C | 26.4 | 6.01 | D |
| Comparative Example2-2 | C | 29.0 | 5.22 | D |
| Comparative Example2-3 | C | 36.2 | 3.64 | D |
| Comparative Example2-4 | C | 41.4 | 2.85 | D |
| Conventional Example2-1 | D | 24.2 | 6.79 | D |
| Conventional Example2-2 | E | 39.6 | 2.06 | D |
| Comparative Example2-5 | A | 51.4 | 2.06 | B |
| Example2-5 | A | 32.2 | 4.43 | B |
| Example2-6 | A | 32.2 | 4.43 | B |
| Example2-7 | A | 32.2 | 4.43 | B |
| Example2-8 | A | 32.2 | 4.43 | B |
| Example2-9 | A | 32.2 | 4.43 | B |
| Example2-10 | A | 32.2 | 4.43 | B |
| Example2-11 | A | 32.0 | 4.43 | B |
| Example2-12 | A | 32.2 | 4.43 | B |
| Example2-13 | A | 32.9 | 4.43 | B |

TABLE 4-continued

| | Evaluation of characteristics | | | |
|---|---|---|---|---|
| | Bending fatigue resistance | Conductor resistance (Ω/km) | Weight of twisted wire conductor (kg/km) | Non-easines in deformation |
| Example2-14 | A | 33.1 | 4.43 | B |
| Example2-15 | A | 32.4 | 4.43 | B |
| Example2-16 | A | 41.3 | 2.06 | B |
| Example2-17 | A | 44.3 | 2.06 | B |
| Example2-18 | A | 46.5 | 2.06 | B |
| Example2-19 | A | 45.6 | 2.06 | B |
| Example2-20 | A | 43.5 | 2.06 | B |
| Example2-21 | A | 3.24 | 48.8 | A |
| Example2-22 | A | 3.55 | 42.7 | A |
| Example2-23 | B | 4.46 | 29.5 | C |
| Example2-24 | B | 5.07 | 23.4 | C |
| Comparative Example2-6 | C | 3.24 | 48.8 | D |
| Comparative Example2-7 | C | 3.55 | 42.7 | D |
| Comparative Example2-8 | C | 4.46 | 29.5 | D |
| Comparative Example2-9 | C | 5.07 | 23.4 | D |
| Conventional Example2-3 | D | 2.97 | 55.4 | D |
| Conventional Example2-4 | E | 4.86 | 16.8 | D |
| Comparative Example2-10 | A | 5.93 | 16.8 | B |

TABLE 5-1

| | Twisted wire conductor 10 | | | | | | | |
|---|---|---|---|---|---|---|---|---|
| | First conductor 20 | | | | | | | |
| | | Alloy composition (mass %) | | | | | | |
| | | | | | Other alloy component | | | |
| | Installation number (pieces) | Mg | Si | Fe | Component 1 | Component 2 | Component 3 | Total content |
| Example3-1 | 5 | 0.54 | 0.52 | 0.19 | — | — | — | <0.05 |
| Example3-2 | 10 | 0.54 | 0.52 | 0.19 | — | — | — | <0.05 |
| Example3-3 | 20 | 0.54 | 0.52 | 0.19 | — | — | — | <0.05 |
| Example3-4 | 25 | 0.54 | 0.52 | 0.19 | — | — | — | <0.05 |
| Comparative Example3-1 | 5 | 0.54 | 0.52 | 0.19 | — | — | — | <0.05 |
| Comparative Example3-2 | 10 | 0.54 | 0.52 | 0.19 | — | — | — | <0.05 |
| Comparative Example3-3 | 20 | 0.54 | 0.52 | 0.19 | — | — | — | <0.05 |
| Comparative Example3-4 | 25 | 0.54 | 0.52 | 0.19 | — | — | — | <0.05 |
| Conventional Example3-1 | 0 | — | — | — | — | — | — | <0.05 |
| Conventional Example3-2 | 0 | — | — | — | — | — | — | <0.05 |
| Comparative Example3-5 | 30 | 0.54 | 0.52 | 0.19 | — | — | — | <0.05 |
| Example3-5 | 15 | 0.54 | 0.52 | 0.19 | — | — | — | <0.05 |
| Example3-6 | 15 | 0.54 | 0.52 | 0.19 | — | — | — | <0.05 |
| Example3-7 | 15 | 0.54 | 0.52 | 0.19 | — | — | — | <0.05 |
| Example3-8 | 15 | 0.54 | 0.52 | 0.19 | — | — | — | <0.05 |
| Example3-9 | 15 | 0.54 | 0.52 | 0.19 | — | — | — | <0.05 |
| Example3-10 | 15 | 0.54 | 0.52 | 0.19 | — | — | — | <0.05 |
| Example3-11 | 15 | 0.54 | 0.52 | 0.19 | — | — | — | <0.05 |
| Example3-12 | 15 | 0.54 | 0.52 | 0.31 | — | — | — | <0.05 |

TABLE 5-1-continued

| | Twisted wire conductor 10 | | | | | | | | | |
|---|---|---|---|---|---|---|---|---|---|---|
| | First conductor 20 | | | | | | | | | |
| | Metal structure | | | | Second conductor 40 | | | | | |
| | Presence or absence of fibrous metal structure | Dimension t perpendicular to longitudinal direction of crystal grain | Aspect ratio of crystal grain | Production conditions | Installation number (pieces) | Type of material | Twist structure | Proportion of the number of first conductors A (%) | Proportion of the number of first conductors B2 (%) | B2/A |
| Example3-1 | Present | 130 nm | >10 | B | 25 | TPC(O) | 30/0.18 | 16.7 | 33.3 | 1.99 |
| Example3-2 | Present | 130 nm | >10 | B | 20 | TPC(O) | 30/0.18 | 33.3 | 66.7 | 2.00 |
| Example3-3 | Present | 130 nm | >10 | B | 10 | TPC(O) | 30/0.18 | 66.6 | 100.0 | 1.50 |
| Example3-4 | Present | 130 nm | >10 | B | 5 | TPC(O) | 30/0.18 | 83.3 | 100.0 | 1.20 |
| Comparative Example3-1 | Present | 130 nm | >10 | B | 25 | TPC(O) | 30/0.18 | 16.7 | 13.3 | 0.80 |
| Comparative Example3-2 | Present | 130 nm | >10 | B | 20 | TPC(O) | 30/0.18 | 33.3 | 26.7 | 0.80 |
| Comparative Example3-3 | Present | 130 nm | >10 | B | 10 | TPC(O) | 30/0.18 | 66.6 | 50.0 | 0.80 |
| Comparative Example3-4 | Present | 130 nm | >10 | B | 5 | TPC(O) | 30/0.18 | 83.3 | 80.0 | 0.96 |
| Conventional Example3-1 | — | — | — | — | 30 | TPC(O) | 30/0.18 | 0 | 0 | — |
| Conventional Example3-2 | — | — | — | — | 30 | EC-AL(H) | 30/0.18 | 0 | 0 | — |
| Comparative Example3-5 | Present | 130 nm | >10 | B | 0 | — | 30/0.18 | 100.0 | 100.0 | 1.00 |
| Example3-5 | Present | 320 nm | >10 | A | 15 | TPC(O) | 30/0.18 | 66.6 | 100.0 | 2.00 |
| Example3-6 | Present | 80 nm | >10 | C | 15 | TPC(O) | 30/0.18 | 66.6 | 100.0 | 2.00 |
| Example3-7 | Present | 340 nm | >10 | D | 15 | TPC(O) | 30/0.18 | 66.6 | 100.0 | 2.00 |
| Example3-8 | Present | 240 nm | >10 | E | 15 | TPC(O) | 30/0.18 | 66.6 | 100.0 | 2.00 |
| Example3-9 | Present | 150 nm | >10 | F | 15 | TPC(O) | 30/0.18 | 66.6 | 100.0 | 2.00 |
| Example3-10 | Present | 100 nm | >10 | G | 15 | TPC(O) | 30/0.18 | 66.6 | 100.0 | 2.00 |
| Example3-11 | Present | 140 nm | >10 | B | 15 | TPC(O) | 30/0.18 | 66.6 | 100.0 | 2.00 |
| Example3-12 | Present | 110 nm | >10 | B | 15 | TPC(O) | 30/0.18 | 66.6 | 100.0 | 2.00 |

TABLE 5-2

| | Twisted wire conductor 10 | | | | | | | |
|---|---|---|---|---|---|---|---|---|
| | First conductor 20 | | | | | | | |
| | | Alloy composition (mass %) | | | | | | |
| | | | | | Other alloy component | | | |
| | Installation number (pieces) | Mg | Si | Fe | Component 1 | Component 2 | Component 3 | Total content |
| Example3-13 | 15 | 0.54 | 0.52 | 0.19 | 0.08 Zr | 0.08 Kn | — | 0.16 |
| Example3-14 | 15 | 0.54 | 0.52 | 0.19 | 0.12 Ni | 0.08 Sn | 0.07 Au | 0.27 |
| Example3-15 | 15 | 0.54 | 0.52 | 0.19 | 0.06 Ti | 0.07 K | 0.07 Co | 0.20 |
| Example3-16 | 15 | 0.22 | 0.22 | 0.19 | — | — | — | <0.05 |
| Example3-17 | 15 | 1.75 | 1.94 | 0.19 | — | — | — | <0.05 |
| Example3-18 | 15 | 0.95 | 0.58 | 0.28 | 1.44 Cu | 045 Cr | — | 1.89 |
| Example3-19 | 15 | 0.54 | 0.52 | 0.19 | 0.15 Ag | 0.11 Zn | — | 0.26 |
| Example3-20 | 15 | 0.54 | 0.52 | 0.19 | — | — | — | <0.05 |
| Example3-21 | 15 | 0.54 | 0.52 | 0.19 | — | — | — | <0.05 |
| Example3-22 | 29 | 0.54 | 0.52 | 0.19 | — | — | — | <0.05 |
| Example3-23 | 59 | 0.54 | 0.52 | 0.19 | — | — | — | <0.05 |
| Example3-24 | 73 | 0.54 | 0.52 | 0.19 | — | — | — | <0.05 |
| Comparative Example3-6 | 15 | 0.54 | 0.52 | 0.19 | | | | <0.05 |
| Comparative Example3-7 | 29 | 0.54 | 0.52 | 0.19 | — | — | — | <0.05 |
| Comparative Example3-8 | 59 | 0.54 | 0.52 | 0.19 | — | — | — | <0.05 |
| Comparative Example3-9 | 73 | 0.54 | 0.52 | 0.19 | — | — | — | <0.05 |
| Conventional Example3-3 | 0 | 0.54 | — | — | — | — | — | — |
| Conventional Example3-4 | 0 | 0.54 | — | — | — | — | — | — |

TABLE 5-2-continued

| | | | | | | | | | |
|---|---|---|---|---|---|---|---|---|---|
| Comparative Example3-10 | 88 | 0.54 | 0.52 | 0.19 | — | — | — | <0.05 | |

Twisted wire conductor 10

| | First conductor 20 | | | | | | | | | |
|---|---|---|---|---|---|---|---|---|---|---|
| | Metal structure | | | | Second conductor 40 | | | | | |
| | Presence or absence of fibrous metal structure | Dimension t perpendicular to longitudinal direction of crystal grain | Aspect ratio of crystal grain | Production conditions | Installation number (pieces) | Type of material | Twist structure | Proportion of the number of first conductors A (%) | Proportion of the number of first conductors B2 (%) | B2/A |
| Example3-13 | Present | 80 nm | >10 | B | 15 | TPC(O) | 30/0.18 | 66.6 | 100.0 | 2.00 |
| Example3-14 | Present | 80 nm | >10 | B | 15 | TPC(O) | 30/0.18 | 66.6 | 100.0 | 2.00 |
| Example3-15 | Present | 80 nm | >10 | B | 15 | TPC(O) | 30/0.18 | 66.6 | 100.0 | 2.00 |
| Example3-16 | Present | 160 nm | >10 | B | 15 | EC-AL(H) | 30/0.18 | 66.6 | 100.0 | 2.00 |
| Example3-17 | Present | 80 nm | >10 | B | 15 | EC-AL(H) | 30/0.18 | 66.6 | 100.0 | 2.00 |
| Example3-18 | Present | 90 nm | >10 | B | 15 | EC-AL(H) | 30/0.18 | 66.6 | 100.0 | 2.00 |
| Example3-19 | Present | 100 nm | >10 | B | 15 | EC-AL(H) | 30/0.18 | 66.6 | 100.0 | 2.00 |
| Example3-20 | Present | 130 nm | >10 | B | 15 | EC-AL(H) | 30/0.18 | 66.6 | 100.0 | 2.00 |
| Example3-21 | Present | 130 nm | >10 | B | 79 | TPC(O) | 88/0.30 | 17.0 | 44.1 | 2.58 |
| Example3-22 | Present | 130 nm | >10 | B | 59 | TPC(O) | 88/0.30 | 33.0 | 85.3 | 2.58 |
| Example3-23 | Present | 130 nm | >10 | B | 29 | TPC(O) | 88/0.30 | 67.0 | 100.0 | 1.49 |
| Example3-24 | Present | 130 nm | >10 | B | 15 | TPC(O) | 88/0.30 | 83.0 | 100.0 | 1.20 |
| Comparative Example3-6 | Present | 130 nm | >10 | D | 73 | TPC(O) | 88/0.30 | 17.0 | 14.7 | 0.86 |
| Comparative Example3-7 | Present | 130 nm | >10 | B | 59 | TPC(O) | 88/0.30 | 33.0 | 32.4 | 0.98 |
| Comparative Example3-8 | Present | 130 nm | >10 | B | 29 | TPC(O) | 88/0.30 | 67.0 | 64.7 | 0.97 |
| Comparative Example3-9 | Present | 130 nm | >10 | B | 15 | TPC(O) | 88/0.30 | 83.0 | 79.4 | 0.96 |
| Conventional Example3-3 | — | — | — | — | 68 | TPC(O) | 88/0.30 | 0 | 0 | — |
| Conventional Example3-4 | — | — | — | — | 68 | EC-AL(H) | 88/0.30 | 0 | 0 | — |
| Comparative Example3-10 | Present | 130 nm | >10 | B | 0 | — | 88/0.30 | 100.0 | 100.0 | 1.00 |

TABLE 6

| | Evaluation of characteristics | | | |
|---|---|---|---|---|
| | Bending fatigue resistance | Conductor resistance (Ω/km) | Weight of twisted wire conductor (kg/km) | Non-easines in deformation |
| Example3-1 | 0 | 26.4 | 6.01 | A |
| Example3-2 | 0 | 29.0 | 5.22 | A |
| Example3-3 | 0 | 36.2 | 3.64 | B |
| Example3-4 | 0 | 41.4 | 2.85 | C |
| Comparative Example3-1 | 0 | 26.4 | 6.01 | D |
| Comparative Example3-2 | 0 | 29.0 | 5.22 | D |
| Comparative Example3-3 | 0 | 36.2 | 3.64 | D |
| Comparative Example3-4 | 0 | 41.4 | 2.85 | D |
| Conventional Example3-1 | 0 | 24.2 | 6.79 | B |
| Conventional Example3-2 | 100 | 39.6 | 2.06 | D |
| Comparative Example3-5 | 0 | 51.4 | 2.06 | D |
| Example3-5 | 0 | 32.2 | 4.43 | A |
| Example3-6 | 0 | 32.2 | 4.43 | A |
| Example3-7 | 0 | 32.2 | 4.43 | A |
| Example3-8 | 0 | 32.2 | 4.43 | A |
| Example3-9 | 0 | 32.2 | 4.43 | A |
| Example3-10 | 0 | 32.2 | 4.43 | A |
| Example3-11 | 0 | 32.0 | 4.43 | A |

TABLE 6-continued

| | Evaluation of characteristics | | | |
|---|---|---|---|---|
| | Bending fatigue resistance | Conductor resistance (Ω/km) | Weight of twisted wire conductor (kg/km) | Non-easines in deformation |
| Example3-12 | 0 | 32.2 | 4.43 | A |
| Example3-13 | 0 | 32.9 | 4.43 | A |
| Example3-14 | 0 | 33.1 | 4.43 | A |
| Example3-15 | 0 | 32.4 | 4.43 | A |
| Example3-16 | 10 | 41.3 | 2.06 | A |
| Example3-17 | 0 | 44.3 | 2.06 | A |
| Example3-18 | 0 | 46.5 | 2.06 | A |
| Example3-19 | 0 | 45.6 | 2.06 | A |
| Example3-20 | 0 | 43.5 | 2.06 | A |
| Example3-21 | 0 | 3.24 | 48.8 | A |
| Example3-22 | 0 | 3.55 | 42.7 | A |
| Example3-23 | 0 | 4.46 | 29.5 | C |
| Example3-24 | 0 | 5.07 | 23.4 | C |
| Comparative Example3-6 | 0 | 3.24 | 48.8 | D |
| Comparative Example3-7 | 0 | 3.55 | 42.7 | D |
| Comparative Example3-8 | 0 | 4.46 | 29.5 | D |
| Comparative Example3-9 | 0 | 5.07 | 23.4 | D |
| Conventional Example3-3 | 0 | 2.97 | 55.4 | B |

TABLE 6-continued

| | Evaluation of characteristics | | | |
|---|---|---|---|---|
| | Bending fatigue resistance | Conductor resistance (Ω/km) | Weight of twisted wire conductor (kg/km) | Non-easines in deformation |
| Conventional Example3-4 | 100 | 4.86 | 16.8 | D |
| Comparative Example3-10 | 0 | 5.93 | 16.8 | D |

From the results of Table 1 and Table 2, it was verified that in the twisted wire conductors of Examples 1-1 to 1-30, the first conductors have a particular alloy composition and have a fibrous metal structure in which crystal grains extend to be aligned in one direction, and in a cross-section parallel to the one direction, a dimension perpendicular to the longitudinal direction of the crystal grains is 400 nm or less. FIG. 11 is a STEM image of a cross-section parallel to the direction of wire drawing of the first conductors according to Example 1-1. Meanwhile, also for a cross-section parallel to the longitudinal direction of the first conductors according to Examples 1-2 to Example 1-30, metal structures similar to FIG. 11 were recognized. It was verified that the twisted wire conductors of Examples 1-1 to 1-30 of the present invention having such a unique metal structure exhibit high strength comparable to iron-based or copper-based twisted wire conductors. Furthermore, it was verified that since the twisted wire conductors of Examples 1-12 to 1-14, 1-22, and 1-23 of the present invention contained at least one or more selected from Cu, Ag, Zn, Ni, Co, Au, Mn, Cr, V, Zr, Ti, and Sn in a predetermined amount, the twisted wire conductors maintain high fatigue life characteristics even after heating and have excellent heat resistance.

In contrast, the twisted wire conductors of Conventional Example 1-1 and Conventional Example 1-3, in which the twisted wire conductors were constructed only of second conductors formed from a pure copper material (tough pitch copper), were such that the weight of the twisted wire conductor was heavy, and Conventional Examples 1-2 and 1-4 in which the twisted wire conductors were constructed only of second conductors formed from a pure aluminum material (EC-Al material) had poor bending fatigue resistance and were all unacceptable. Furthermore, the twisted wire conductor of Comparative Example 1-1 in which the twisted wire conductor was constructed using first conductors having the appropriate composition range of the present invention without using second conductors, had high conductor resistance and inferior electrical conductivity. The twisted wire conductor of Comparative Example 1-2 produced using a rod material for first conductor in which the contents of Mg and Si were less than the appropriate ranges of the present invention had inferior fatigue characteristics. The twisted wire conductor of Comparative Example 1-4 produced using a rod material for first conductor that did not contain Fe had inferior fatigue characteristics. The twisted wire conductor of Comparative Example 1-7 in which the average value of a dimension perpendicular to the longitudinal direction of the crystal grains was larger than the appropriate range of the present invention had inferior fatigue characteristics. Furthermore, in Comparative Examples 1-3, 1-5, 1-6, and 1-8, since breaking of wire occurred during wire drawing [1], production of the twisted wire conductor could not be carried out.

From the results of Tables 3 and 4, it was verified that the twisted wire conductors of Examples 2-1 to 2-24 are such that the first conductors have a particular alloy composition and have a fibrous metal structure in which the crystal grains extend to be aligned in one direction, and in a cross-section parallel to the one direction, the dimension perpendicular to the longitudinal direction of the crystal grains is 400 nm or less. Also for cross-sections parallel to the longitudinal direction of the first conductors according to Examples 2-1 to 2-24, a metal structure similar to FIG. 11 was recognized.

It was verified that the twisted wire conductors of Examples 2-1 to 2-24 of the present invention having such a unique metal structure exhibits high strength comparable to iron-based and copper-based twisted wire conductors. Furthermore, since the twisted wire conductors of Examples 2-13 to 2-15, 2-18, and 2-19 of the present invention contain at least one or more elements selected from Cu, Ag, Zn, Ni, Co, Au, Mn, Cr, V, Zr, Ti, and Sn in predetermined amounts, it was verified that the twisted wire conductors maintain excellent fatigue life characteristics even after heating and have excellent heat resistance.

In contrast, the twisted wire conductors of Conventional Example 2-1 and Conventional Example 2-3, in which the twisted wire conductor was constructed only of second conductors formed from a pure copper material (tough pitch copper) had inferior fatigue characteristics and difficulty in deformation, and the weights of the twisted wire conductors were heavy. Furthermore, Conventional Examples 2-2 and 2-4 in which the twisted wire conductor was constructed only of second conductors formed from a pure aluminum material (EC-Al material) had inferior fatigue characteristics and difficulty in deformation and were all unacceptable. Furthermore, the twisted wire conductors of Comparative Examples 2-1 to 2-4 and 2-6 to 2-9, in which twisted wire conductors were configured to have a lower proportion A of the number of first conductors than the proportion B1 of the number of first conductors, had inferior fatigue characteristics and difficulty in deformation and were all unacceptable. Furthermore, in Comparative Examples 2-5 and 2-10 in which the twisted wire conductor was constructed only of first conductors, the conductor resistance increased, and the twisted wire conductors were all unacceptable.

From the results of Tables 5 and 6, in the twisted wire conductors of Examples 3-1 to 3-24, it was verified that the first conductors have a particular alloy composition and have a fibrous metal structure in which the crystal grains extend to be aligned in one direction, and in a cross-section parallel to the one direction, the dimension perpendicular to the longitudinal direction of the crystal grains is 400 nm or less. Also in the cross-sections parallel to the longitudinal direction of the first conductors according to Examples 3-1 to 3-24, a metal structure similar to FIG. 11 was recognized.

It was verified that the twisted wire conductors of Examples 3-1 to 3-24 of the present invention having such a unique metal structure exhibit high strength comparable to iron-based and copper-based twisted wire conductors. Furthermore, it was verified that since the twisted wire conductors of Examples 3-13 to 3-15, 3-18, and 3-19 of the present invention contain at least one or more elements selected from Cu, Ag, Zn, Ni, Co, Au, Mn, Cr, V, Zr, Ti, and Sn in predetermined amounts, the twisted wire conductors maintain excellent fatigue life characteristics even after heating and have excellent heat resistance.

In contrast, the twisted wire conductors of Conventional Examples 3-1 and 3-3 in which the twisted wire conductor was constructed only of second conductors formed from a pure copper material (tough pitch copper) were such that the weights of the twisted wire conductors were heavy, and Conventional Examples 3-2 and 3-4 in which the twisted wire conductor was constructed only of second conductors formed from a pure aluminum material (EC-Al material) exhibited inferior fatigue characteristics and ease of deformation, so that all were unacceptable. Furthermore, the twisted wire conductors of Comparative Examples 3-1 to 3-4 and 3-6 to 3-9, in which the twisted wire conductor was configured to have a lower proportion B2 of the number of first conductors than the proportion A of the number of first conductors, had inferior ease of deformation, and all were unacceptable. Furthermore, Comparative Examples 3-5 and 3-10 in which the twisted wire conductor was constructed only of first conductors exhibited increased conductor resistance and also exhibited inferior ease of deformation, and all were unacceptable.

INDUSTRIAL APPLICABILITY

According to the present invention, by using, as a twisted wire conductor, first conductors formed from a specific aluminum alloy having high strength and excellent bending fatigue resistance in place of a portion of second conductors formed from a conventional copper-based material or aluminum-based material having high electrical conductivity, a twisted wire conductor for an insulated electrical wire, which has high electrical conductivity and high strength and has excellent bending fatigue resistance, and in which weight reduction can be attempted; an insulated electrical wire; a cord; and a cable, can be provided. Furthermore, by using, as conductors of a twisted wire conductor, first conductors formed from a specific aluminum alloy having high strength and excellent bending fatigue resistance in place of a portion of second conductors formed from a conventional copper-based material or aluminum-based material having high electrical conductivity, and at the same time, by adjusting the proportion B1 of the number of first conductors to be higher than the proportion A of the number of first conductors, a twisted wire conductor for an insulated electrical wire, which has high electrical conductivity and high strength and has excellent bending fatigue resistance, in which weight reduction is attempted, and copper damage is not likely to occur, and which can exhibit satisfactory connection to the aluminum terminal and can easily undergo deformation; an insulated electrical wire; a cord; and a cable can be provided. Furthermore, by using, as conductors of a twisted wire conductor, first conductors formed from a specific aluminum alloy having high strength and excellent bending fatigue resistance in place of a portion of second conductors formed from a conventional copper-based material or aluminum-based material having high electrical conductivity, and at the same time, by adjusting the proportion B2 of the number of first conductors to be higher than the proportion A of the number of first conductors, a twisted wire conductor for an insulated electrical wire, which has high electrical conductivity and high strength and has excellent bending fatigue resistance, in which weight reduction is attempted, and which can easily undergo deformation; an insulated electrical wire; a cord; and a cable can be provided.

EXPLANATION OF REFERENCE NUMERALS

1 CRYSTAL GRAIN
10A TO 10I TWISTED WIRE CONDUCTOR
20 FIRST CONDUCTOR
40 SECOND CONDUCTOR
60 OUTERMOST LAYER OF TWISTED WIRE CONDUCTOR
80 REGION (PARTITIONED BY VIRTUAL CIRCLE) OF TWISTED WIRE CONDUCTOR

The invention claimed is:

1. A twisted wire conductor for an insulated electrical wire, the twisted wire conductor being configured to be in a mixed state in which first conductors and second conductors are twisted together, the first conductors comprising a specific aluminum alloy having an alloy composition containing, by mass %, 0.2% to 1.8% of Mg, 0.2% to 2.0% of Si, 0.01% to 0.33% of Fe, and 0.00% to 2.00% in total of one or more elements selected from the group consisting of Cu, Ag, Zn, Ni, Co, Au, Mn, Cr, V, Zr, Ti, and Sn, with the remainder being Al and unavoidable impurities, the specific aluminum alloy having a fibrous metal structure in which crystal grains extend to be aligned in one direction, and in a cross-section parallel to the one direction, an average value of a dimension perpendicular to a longitudinal direction of the crystal grains is 400 nm or less; and the second conductors comprising a metal or an alloy selected from the group consisting of copper, copper alloy, aluminum, and aluminum alloy, and having higher electrical conductivity than the first conductors.

2. The twisted wire conductor for an insulated electrical wire according to claim 1, wherein when viewed from a transverse cross-section of the twisted wire conductor, a proportion B1 occupied by the number of first conductors in the total number of first conductors and second conductors, which are positioned in an outermost layer of the twisted wire conductor, is higher than a proportion A occupied by the number of first conductors in the total number of first conductors and second conductors constituting the twisted wire conductor.

3. The twisted wire conductor for an insulated electrical wire according to claim 2, wherein the ratio (B1/A) of the proportion B1 occupied by the number of first conductors in the total number of first conductors and second conductors, which are positioned in the outermost layer, to the proportion A occupied by the number of first conductors in the total number of first conductors and second conductors constituting the twisted wire conductor is 1.50 or higher.

4. The twisted wire conductor for an insulated electrical wire according to claim 1, wherein when viewed from a transverse cross-section of the twisted wire conductor, a proportion B2 occupied by the number of first conductors in the total number of first conductors and second conductors, which are positioned within a region partitioned by a virtual circle that is concentric with a circumscribed circle of the twisted wire conductor and has a radius equal to a half of a radius of the circumscribed circle, is higher than the proportion A occupied by the number of first conductors in the total number of first conductors and second conductors constituting the twisted wire conductor.

5. The twisted wire conductor for an insulated electrical wire according to claim 4, wherein the ratio (B2/A) of the proportion B2 occupied by the number of first conductors in the total number of first conductors and second conductors, which are positioned within the region, to the proportion A occupied by the number of first conductors in the total number of first conductors and second conductors constituting the twisted wire conductor, is 1.50 or higher.

6. The twisted wire conductor for an insulated electrical wire according to claim 1, wherein when viewed from a transverse cross-section of the twisted wire conductor, a total cross-sectional area of the first conductors is in a range of 2% to 98% of a nominal cross-sectional area of the twisted wire conductor.

7. The twisted wire conductor for an insulated electrical wire according to claim 1, wherein the first conductors and the second conductors have the same diameter dimension.

8. The twisted wire conductor for an insulated electrical wire according to claim 1, wherein the first conductors and the second conductors have different diameter dimensions.

9. The twisted wire conductor for an insulated electrical wire according to claim 1, wherein a proportion A occupied by the number of first conductors in the total number of first conductors and second conductors constituting the twisted wire conductor is in a range of 2% to 98%.

10. The twisted wire conductor for an insulated electrical wire according to claim 1, wherein the second conductors are constructed of the copper or the copper alloy.

11. The twisted wire conductor for an insulated electrical wire according to claim 1, wherein the second conductors are constructed of the aluminum or the aluminum alloy.

12. The twisted wire conductor for an insulated electrical wire according to claim 1, wherein the second conductors are configured to be in a mixed state between the copper or the copper alloy and the aluminum or the aluminum alloy.

13. The twisted wire conductor for an insulated electrical wire according to claim 1, wherein the alloy composition of the first conductors contains 0.06% to 2.00% by mass in total of one or more elements selected from the group consisting of Cu, Ag, Zn, Ni, Co, Au, Mn, Cr, V, Zr Ti, and Sn.

14. An insulated electrical wire comprising the twisted wire conductor according to claim 1; and an insulating coating covering an outer periphery of the twisted wire conductor.

15. A cord comprising the twisted wire conductor according to claim 1; and an insulating coating covering an outer periphery of the twisted wire conductor.

16. A cable comprising the insulated electrical wire according to claim 14; and a sheath providing an insulating coating so as to include the insulated electrical wire.

17. The cable according to claim 16, wherein the cable is a cabtire cable.

* * * * *